US009390652B2

(12) United States Patent
Chang et al.

(10) Patent No.: US 9,390,652 B2
(45) Date of Patent: Jul. 12, 2016

(54) ORGANIC LIGHT EMITTING DISPLAY DEVICE AND DRIVING METHOD THEREOF

(71) Applicant: LG Display Co., Ltd., Seoul (KR)

(72) Inventors: Min Kyu Chang, Gyeonggi-do (KR); Jong Sik Shim, Gyeonggi-do (KR); Shinji Takasugi, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 18 days.

(21) Appl. No.: 14/584,050

(22) Filed: Dec. 29, 2014

(65) Prior Publication Data

US 2015/0187273 A1 Jul. 2, 2015

(30) Foreign Application Priority Data

Dec. 30, 2013 (KR) ..... 10-2013-0167896

(51) Int. Cl.
*G09G 5/10* (2006.01)
*G09G 3/32* (2016.01)

(52) U.S. Cl.
CPC ..... *G09G 3/3233* (2013.01); *G09G 3/3291* (2013.01); *G09G 2300/0417* (2013.01); *G09G 2300/0819* (2013.01); *G09G 2300/0852* (2013.01); *G09G 2310/0262* (2013.01); *G09G 2320/0233* (2013.01); *G09G 2320/0285* (2013.01); *G09G 2320/0295* (2013.01); *G09G 2320/043* (2013.01)

(58) Field of Classification Search
CPC . G09G 3/3208; G09G 3/3225; G09G 3/3233; G09G 3/325; G09G 3/3266; G09G 3/3275; G09G 3/3291; G09G 2300/0417; G09G 2300/0439; G09G 2300/0852; G09G 2310/0264; G09G 2320/00
See application file for complete search history.

(56) References Cited

U.S. PATENT DOCUMENTS 8,462,086 B2 * 6/2013 Takasugi ..... G09G 3/3233 345/76
2003/0128199 A1 * 7/2003 Kimura ..... G09G 3/3241 345/204
2004/0251844 A1 * 12/2004 Hashido ..... G09G 3/325 315/169.3
2005/0057459 A1 * 3/2005 Miyazawa ..... G09G 3/3233 345/76
2006/0221009 A1 * 10/2006 Miwa ..... G09G 3/325 345/76
2007/0080905 A1 * 4/2007 Takahara ..... G09G 3/3233 345/76
2008/0084365 A1 * 4/2008 Takahara ..... G09G 3/006 345/76
2010/0079361 A1 * 4/2010 Lee ..... G09G 3/3233 345/77

(Continued)

*Primary Examiner* — Joe H Cheng
(74) *Attorney, Agent, or Firm* — Morgan, Lewis & Bockius LLP

(57) ABSTRACT

Disclosed is an organic light emitting display device including a pixel connected to a data line, a gate line group, and a reference line. The pixel includes an organic light emitting diode (OLED), a driving transistor configured to control a current flowing in the OLED, a first switching transistor configured to selectively supply a data voltage to a first node, a second switching transistor configured to selectively supply an initial voltage to a second node, a third switching transistor configured to selectively connect a third node to the reference line, a fourth switching transistor configured to selectively connect the first node to the third node, a first capacitor connected between the first and second nodes to store a threshold voltage of the driving transistor, and a second capacitor connected between the first and third nodes to store the data voltage supplied through the first switching transistor.

20 Claims, 25 Drawing Sheets

(56) References Cited

U.S. PATENT DOCUMENTS

2011/0109299 A1* 5/2011 Chaji ..... G09G 3/3283 324/76.11
2011/0279433 A1* 11/2011 Ryu ..... G09G 3/3233 345/211
2012/0038605 A1* 2/2012 Han ..... H05B 33/0896 345/211
2013/0093800 A1* 4/2013 Shim ..... G09G 3/3233 345/690
2013/0162620 A1* 6/2013 Kim ..... G09G 3/20 345/212
2014/0152719 A1* 6/2014 Jung ..... G09G 3/3233 345/691
2015/0161940 A1* 6/2015 Woo ..... G09G 3/003 345/58

* cited by examiner

ORGANIC LIGHT EMITTING DISPLAY DEVICE AND DRIVING METHOD THEREOF

CROSS-REFERENCE TO RELATED APPLICATIONS

This application claims the benefit of Korean Patent Application No. 10-2013-0167896, filed on Dec. 30, 2013, which is hereby incorporated by reference as if fully set forth herein.

BACKGROUND OF THE INVENTION

1. Field of the Invention

Embodiments of the present invention relate to an organic light emitting display device and a driving method thereof.

2. Discussion of the Related Art

Recently, with the advancement of multimedia, the importance of flat panel display (FPD) devices is increasing. Therefore, various FPD devices such as liquid crystal display (LCD) devices, plasma display panel (PDP) devices, and organic light emitting display devices are being used practically. The organic light emitting display devices display an image by emitting light from an organic light emitting diode according to a recombination of an electron and a positive hole. The organic light emitting display devices have a fast response time and an unrestricted viewing angle because of their self-emitting light, and thus are attracting much attention as next generation FPD devices.

FIG. 1 is a circuit diagram for describing a pixel structure of a related art organic light emitting display device.

With reference to FIG. 1, each pixel P of the organic light emitting display device may include a switching transistor Tsw, a driving transistor Tdr, a capacitor Cst, and an organic light emitting diode OLED.

The switching transistor Tsw may be turned on according to a scan pulse SP supplied to a scan line SL, and may supply a data voltage Vdata, supplied through a data line DL, to the driving transistor Tdr.

The driving transistor Tdr may be turned on with the data voltage Vdata supplied from the switching transistor Tsw, and may control a data current holed which flows to the organic light emitting diode OLED with a driving voltage EVdd supplied through a driving power line.

The capacitor Cst may be connected between a gate and source of the driving transistor Tdr, may store a voltage corresponding to the data voltage Vdata supplied to the gate of the driving transistor Tdr, and may turn on the driving transistor Tdr with the stored voltage.

The organic light emitting diode OLED may be electrically connected between the source of the driving transistor Tdr and a cathode line EVss, and may emit light with the data current holed supplied from the driving transistor Tdr.

Each pixel P of the organic light emitting display device may control a level of the data current holed, which flows to the light emitting diode OLED, with a switching time of the driving transistor Tdr based on the data voltage Vdata to emit light from the light emitting diode OLED, thereby displaying an image.

However, in the organic light emitting display device of the related art, a driving characteristic of the driving transistor Tdr may change due to non-uniformity of a manufacturing process of a thin film transistor (TFT) and its sequential deterioration. For this reason, the quality of an image may not be uniform.

SUMMARY OF THE INVENTION

Accordingly, an object of the present invention is to provide an organic light emitting display device and a driving method thereof that substantially obviate one or more problems due to limitations and disadvantages of the related art.

Another object of the present invention is to provide an organic light emitting display device and a driving method thereof, which compensate for a driving characteristic change of a driving transistor.

Another object of the present invention is to provide an organic light emitting display device and a driving method thereof, which compensate for a threshold voltage of a driving transistor, and increase the reliability and service life of a switching transistor for compensating for the driving transistor.

Another object of the present invention is to provide an organic light emitting display device and a driving method thereof, which accurately compensate for a threshold voltage and/or mobility deviation of a driving transistor between pixels, thereby improving the quality of an image.

Additional advantages and features of embodiments of the invention will be set forth in part in the description which follows and in part will become apparent to those having ordinary skill in the art upon examination of the following or may be learned from practice of the invention. The objectives and other advantages of embodiments of the invention may be realized and attained by the structure particularly pointed out in the written description and claims hereof as well as the appended drawings.

To achieve these and other advantages and in accordance with the purpose of embodiments of the invention, as embodied and broadly described herein, an organic light emitting display device includes a pixel connected to a data line, a gate line group, and a reference line, wherein the pixel includes: an organic light emitting diode (OLED); a driving transistor configured to control a current flowing in the OLED; a first switching transistor configured to selectively supply a data voltage, supplied to the data line, to a first node; a second switching transistor configured to selectively supply an initial voltage to a second node that is a gate electrode of the driving transistor; a third switching transistor configured to selectively connect a third node, which is a source electrode of the driving transistor, to the reference line; a fourth switching transistor configured to selectively connect the first node to the third node; a first capacitor connected between the first and second nodes to store a threshold voltage of the driving transistor; and a second capacitor connected between the first and third nodes to store the data voltage which is supplied through the first switching transistor.

In another aspect, a method of driving the organic light emitting display device includes: supplying the data voltage to the first node, and supplying the reference voltage to the third node to store a difference voltage between the data voltage and the reference voltage in the second capacitor; and driving the driving transistor with a voltage stored in each of the first and second capacitors to emit light from the OLED, wherein the threshold voltage of the driving transistor is previously stored in the first capacitor.

In another aspect, a method of driving the organic light emitting display device includes: supplying the reference voltage, supplied to the reference line, to the first and third nodes, and supplying the initial voltage to the second node to initialize the first to third nodes; supplying the data voltage to the first node, and supplying the reference voltage to the third node to store a difference voltage between the data voltage and the reference voltage in the second capacitor; and driving the driving transistor with a voltage stored in each of the first and second capacitors to emit light from the OLED, wherein the data voltage may include a compensation voltage for compensating for at least one selected from the threshold voltage and a mobility of the driving transistor.

In another aspect, a method of driving the organic light emitting display device includes: supplying the reference voltage, supplied to the reference line, to the first and third nodes, and supplying the initial voltage to the second node to initialize the first to third nodes; cutting off the reference voltage supplied to the first and third nodes, and supplying the initial voltage to the second node to store the threshold voltage of the driving transistor in the first capacitor; supplying the data voltage to the first node, and supplying the reference voltage to the third node to store a difference voltage between the data voltage and the reference voltage in the second capacitor; and driving the driving transistor with a voltage stored in each of the first and second capacitors to emit light from the OLED.

In another aspect, a method of driving the organic light emitting display device includes: supplying the reference voltage, supplied to the reference line, to the first and third nodes, and supplying the initial voltage to the second node to initialize the first to third nodes; supplying a sensing data voltage, supplied to the data line, to the first node, supplying the reference voltage to the third node for a certain time and then cutting off the reference voltage to store the threshold voltage of the driving transistor in the second capacitor, and transferring the threshold voltage of the driving transistor, stored in the second capacitor, to the first capacitor; supplying the data voltage to the first node, and supplying the reference voltage to the third node to store a difference voltage between the data voltage and the reference voltage in the second capacitor; and driving the driving transistor with a voltage stored in each of the first and second capacitors to emit light from the OLED.

In another aspect, a method of driving the organic light emitting display device includes: (A) supplying the reference voltage, supplied to the reference line, to the first and third nodes, and supplying the initial voltage to the second node to initialize the first to third nodes; and (B) supplying a sensing data voltage, supplied to the data line, to the first node to drive the driving transistor, and sensing the threshold voltage of the driving transistor through the reference line.

It is to be understood that both the foregoing general description and the following detailed description of embodiments of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain principles of the invention. In the drawings.

DETAILED DESCRIPTION OF THE ILLUSTRATED EMBODIMENTS

Reference will now be made in detail to example embodiments of the present invention, examples of which are illustrated in the accompanying drawings. The same or similar reference numbers may be used throughout the drawings to refer to the same or similar parts.

The terms described in the specification should be understood as follows.

As used herein, the singular forms "a", "an" and "the" are intended to include the plural forms as well, unless the context clearly indicates otherwise. The terms "first" and "second" are for differentiating one element from the other element, and these elements should not be limited by these terms. It will be further understood that the terms "comprises", "comprising,", "has", "having", "includes" and/or "including", when used herein, specify the presence of stated features, integers, steps, operations, elements, and/or components, but do not preclude the presence or addition of one or more other features, integers, steps, operations, elements, components, and/or groups thereof. The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Hereinafter, an organic light emitting display device and a driving method thereof according to example embodiments of the present invention will be described in detail with reference to the accompanying drawings.

Figure 1:
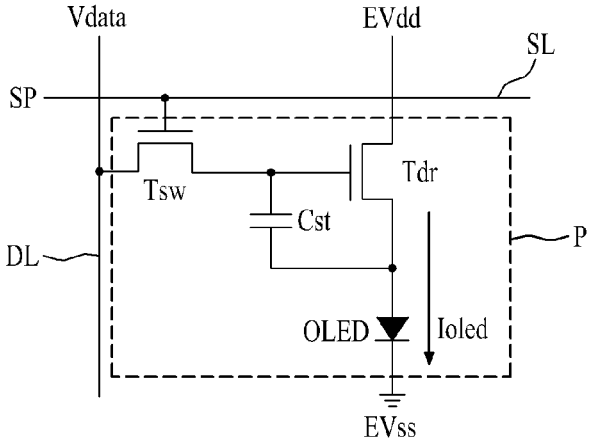
FIG. 1 Related Art
FIG. 1 is a circuit diagram for describing a pixel structure of a related art organic light emitting display device.
Figure 2:
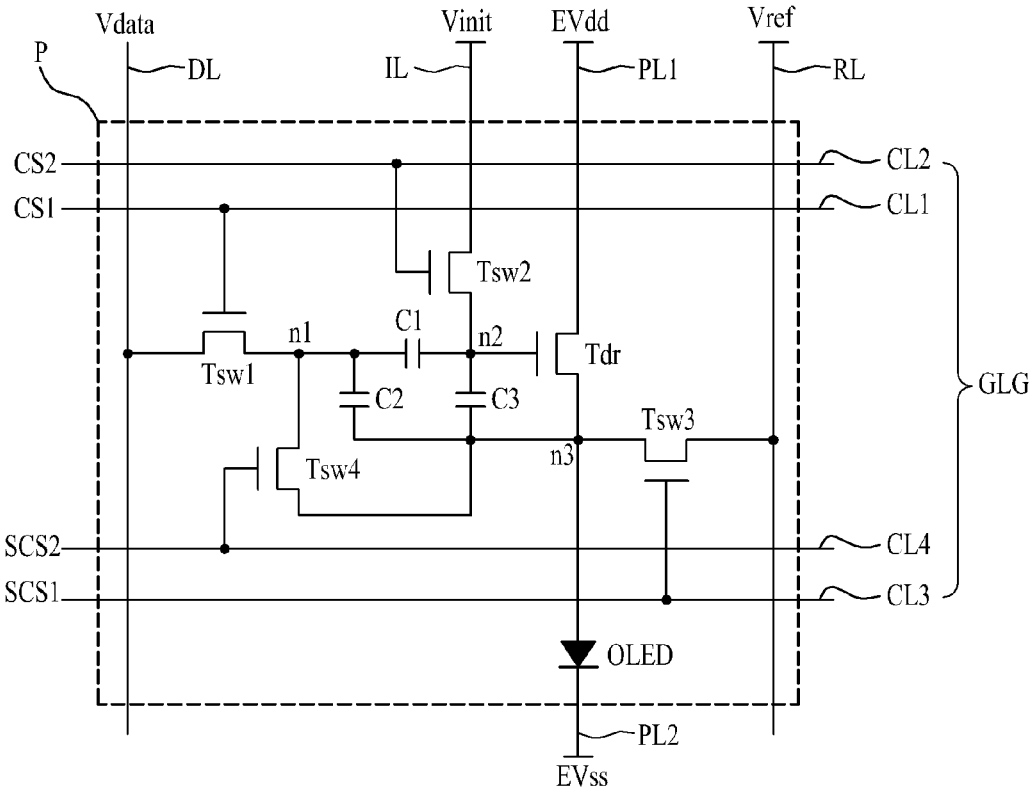
FIG. 2 is a diagram illustrating a pixel structure in an organic light emitting display device according to a first embodiment of the present invention.

FIG. 2 is a diagram illustrating an example of a first embodiment of a pixel structure in an organic light emitting display device. With reference to FIG. 2, a pixel P may be connected to a data line DL, a gate line group GLG, and a reference line RL. Also, the pixel P may be additionally connected to a first driving power line PL1, a second driving power line PL2, and an initial voltage line IL.

The data line DL is formed along a first direction (for example, a height direction) of a display panel (not shown). A data driver (not shown) may supply a data voltage Vdata to the data line DL.

The gate line group GLG may be formed along a second direction (for example, a width direction) of the display panel so as to intersect the data line DL. The gate line group GLG may include a scan control line CL1, an initial control line CL2, a first sensing control line CL3, and a second sensing control line CL4.

The reference line RL may be formed in parallel with the data line DL, and may be supplied with a reference voltage Vref having a constant direct current (DC) level from the outside.

The first driving power line PL1 may be formed in parallel with the data line DL, and may be supplied with a high-level voltage EVdd from the outside. The second driving power line PL2 may be formed in a one-piece form or a line form so as to be connected to an organic light emitting diode (OLED), and may be supplied with a low-level voltage EVss from the outside. The initial voltage line IL may be formed in parallel with the data line DL or the scan control line CL1, and may be supplied with an initial voltage Vinit from the outside. Here, the reference voltage Vref and the initial voltage Vinit may have the same voltage level or different voltage levels.

The pixel P may include an organic light emitting diode OLED, first to fourth switching transistors Tsw1 to Tsw4, first to third capacitors C1 to C3, and a driving transistor Tdr. Here, each of the first to fourth switching transistors Tsw1 to Tsw4 may be an N-type thin film transistor (TFT), and may be an a-Si TFT, a poly-Si TFT, an oxide TFT, or an organic TFT.

The organic light emitting diode OLED may be connected between the first driving power line PL1, through which the high-level voltage EVdd is supplied, and the second driving power line PL2, through which the low-level voltage EVss is supplied. The organic light emitting diode OLED may include an anode electrode connected to a third node n3 that may be a source electrode of the driving transistor Tdr, an organic layer (not shown) formed on the anode electrode, and a cathode electrode connected to the organic layer. Here, the organic layer may be formed to have a structure of a hole transport layer/organic emission layer/electron transport layer or a structure of a hole injection layer/hole transport layer/organic emission layer/electron transport layer/electron injection layer. Furthermore, the organic layer may further include a function layer for enhancing the emission efficiency and/or service life of the organic emission layer. The cathode electrode may be formed by pixel row or pixel column along a length direction of the gate line group GLG or the data line DL, or may be connected to the second driving power line PL2 which may be formed to be connected to all of a plurality of the pixels P in common. The organic light emitting diode OLED emits light with a current which flows from the first driving power line PL1 to the second driving power line PL2 according to driving of the driving transistor Tdr.

The first switching transistor Tsw1 may be turned on by a scan control signal CS1 supplied to the scan control line CL1, and may supply the data voltage Vdata, supplied to the data line DL, to a first node n1. To this end, the first switching transistor Tsw1 may include a gate electrode connected to the scan control line CL1, a first electrode connected to the data line DL, and a second electrode connected to the first node n1. Here, each of the first and second electrodes of the first switching transistor Tsw1 may be a source electrode or a drain electrode depending on a direction of a current.

The second switching transistor Tsw2 may be turned on by an initial control signal CS2 supplied to the initial control line CL2, and may supply the initial voltage Vinit, supplied to the initial voltage line IL, to a second node n2 that may be a gate electrode of the driving transistor Tdr. To this end, the second switching transistor Tsw2 may include a gate electrode connected to the initial control line CL2, a first electrode connected to the initial voltage line IL, and a second electrode connected to the second node n2. Here, each of the first and second electrodes of the second switching transistor Tsw2 may be a source electrode or a drain electrode depending on a direction of a current.

The third switching transistor Tsw3 may be turned on by a first sensing control signal SCS1 supplied to the first sensing control line CL3, and may connect a reference line RL to a third node n3 that may be a source electrode of the driving transistor Tdr. To this end, the third switching transistor Tsw3 may include a gate electrode connected to the first sensing control line CL3, a first electrode connected to the reference line RL, and a second electrode connected to the third node n3. Here, each of the first and second electrodes of the third switching transistor Tsw3 may be a source electrode or a drain electrode depending on a direction of a current.

The fourth switching transistor Tsw4 may be turned on by a second sensing control signal SCS2 supplied to the second sensing control line CL4, and may connect the first node n1 to the third node n3 that may be a source electrode of the driving transistor Tdr. To this end, the fourth switching transistor Tsw4 may include a gate electrode connected to the second sensing control line CL4, a first electrode connected to the first node n1, and a second electrode connected to the third node n3. Here, each of the first and second electrodes of the fourth switching transistor Tsw4 may be a source electrode or a drain electrode depending on a direction of a current.

The first capacitor C1 may be connected between the first and second nodes n1 and n2, and may store a gate-source voltage (i.e., a threshold voltage (Vth)) of the driving transistor Tdr according to the switching of the first to fourth switching transistors Tsw1 to Tsw4. To this end, a first electrode of the first capacitor C1 may be connected to the first node n1, and a second electrode of the first capacitor C1 may be connected to the second node n2.

The second capacitor C2 may be connected between the first and third nodes n1 and n3, may store the data voltage Vdata supplied through the first switching transistor Tsw1, and may drive the driving transistor Tdr with the stored voltage. To this end, a first electrode of the second capacitor C2 may be connected to the first node n1, and a second electrode of the second capacitor C2 may be connected to the third node n3.

The third capacitor C3 may be connected between the second and third nodes n2 and n3, may store a gate-source voltage of the driving transistor Tdr according to the switching of the first to fourth switching transistors Tsw1 to Tsw4, and may drive the driving transistor Tdr with the stored voltage. To this end, a first electrode of the third capacitor C3 may be connected to the second node n2, and a second electrode of the third capacitor C3 may be connected to the third node n3. In some embodiments, the third capacitor C3 may be omitted, and the third capacitor C3 may be a parasitic capacitor between a gate electrode and a source electrode of the driving transistor Tdr.

The driving transistor Tdr may be connected between the first driving power line PL1 and the anode electrode of the organic light emitting diode OLED. The driving transistor Tdr may be driven by the voltages respectively stored in the first and second capacitors C1 and C2, or the voltages respectively stored in the first to third capacitors C1 to C3, and may control a current which flows from the first driving power line PL1 to the organic light emitting diode OLED.

The pixel P may operate in a mode selected from a display mode, a normal compensation mode, an amplification compensation mode, and an external sensing mode.

The display mode may be defined as a method that drives the pixel P with input data without compensating for the threshold voltage of the driving transistor Tdr.

The normal compensation mode may be defined as an internal compensation method that drives the driving transistor Tdr with a difference voltage "Vinit−Vref" between the initial voltage Vinit and the reference voltage Vref, samples the threshold voltage of the driving transistor Tdr, stores the sampled voltage in the first capacitor C1, and compensates for the threshold voltage of the driving transistor Tdr with the voltage stored in the first capacitor C1.

The amplification compensation mode may be defined as an internal compensation method that drives the driving transistor Tdr with a data voltage for sampling and the initial voltage Vinit, samples the threshold voltage of the driving transistor Tdr, stores the sampled voltage in the first capacitor C1, and compensates for the threshold voltage of the driving transistor Tdr with the voltage stored in the first capacitor C1.

The external sensing mode may be defined as an external compensation method that senses the threshold voltage of the driving transistor Tdr through the reference line RL to generate sensing data, and corrects input data with the sensing data to compensate for the threshold voltage of the driving transistor Tdr.

The normal compensation mode, the amplification compensation mode, and the external sensing mode may be methods that perform sensing in units of at least one horizontal line according to a user's setting, at every set period (or time), or at every vertical blank interval, and may be performed during a plurality of frames, or may be sequentially performed for all horizontal lines within at least one frame at every power-on period of the organic light emitting display device, power-off period of the organic light emitting display device, power-on period after a set driving time, or power-off period after the set driving time. Here, the vertical blank interval may be set to overlap a blank interval of a vertical synch signal in a period between a last data enable signal of a previous frame and a first data enable signal of a current frame.

Figure 3A:
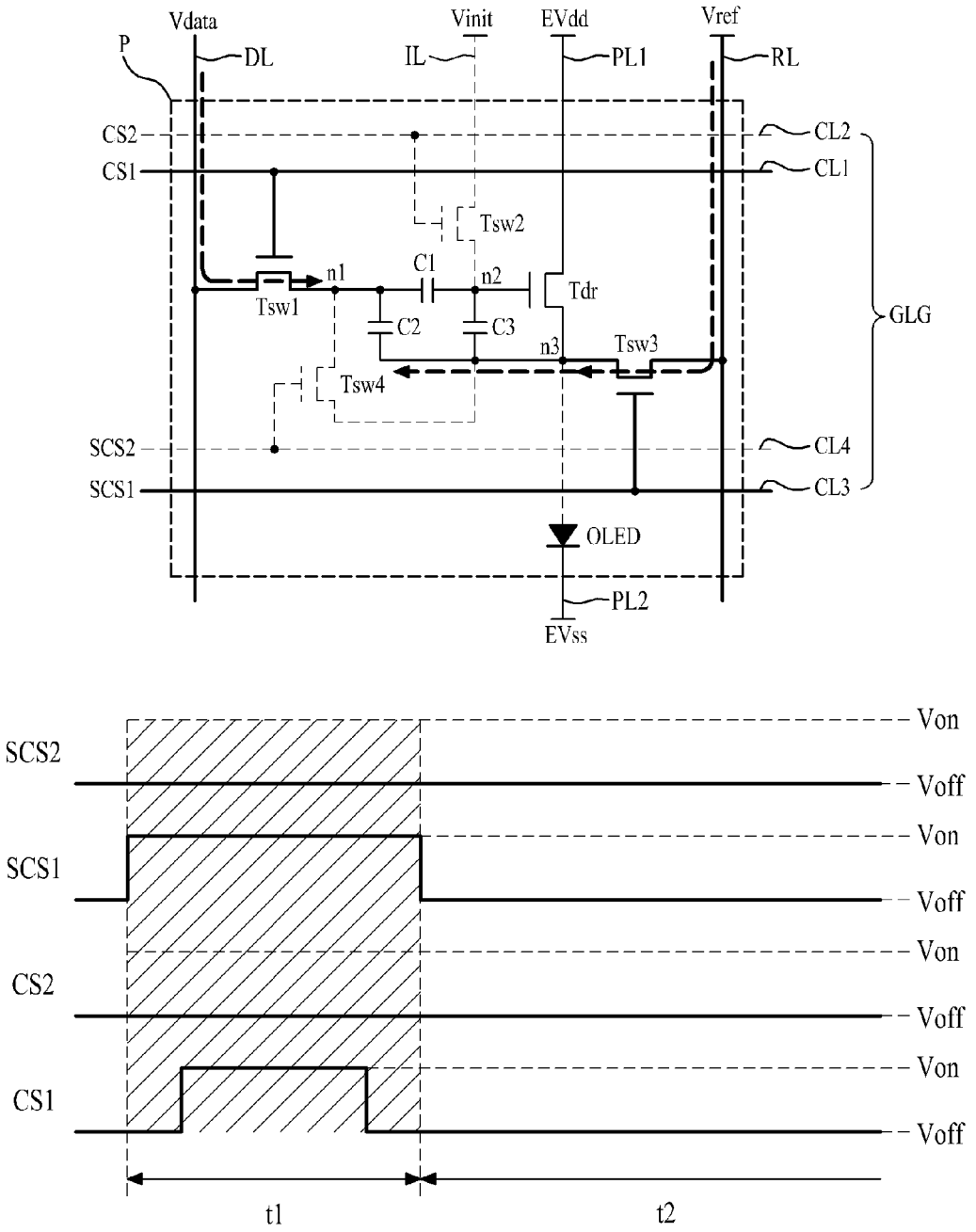
FIGS. 3A to 3C are diagrams for describing a driving method in a display mode for a pixel illustrated in FIG. 2.
Figure 3B:
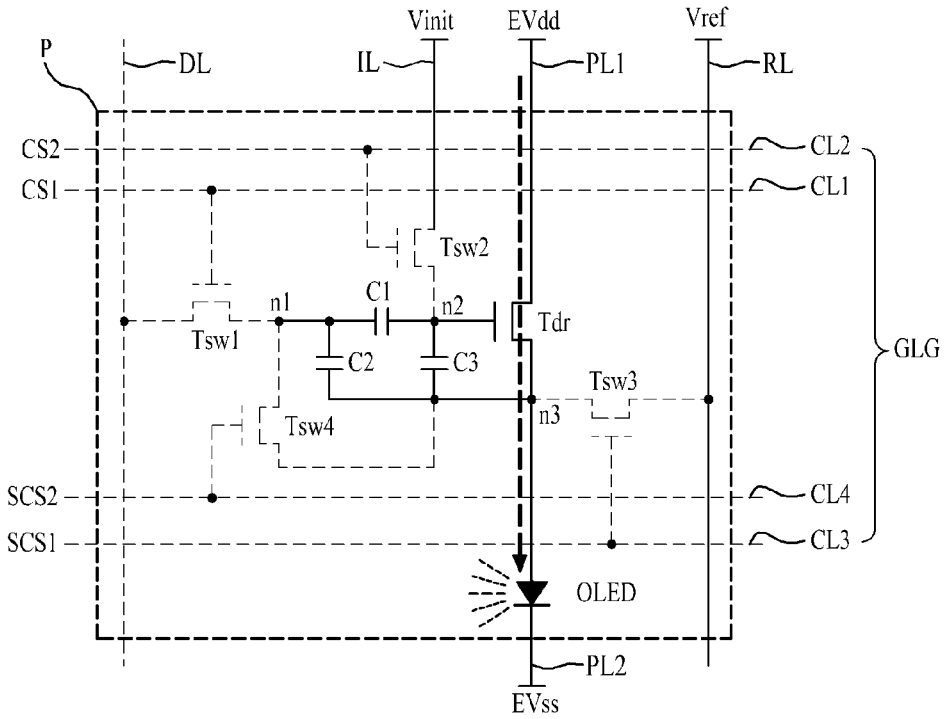
Figure 3B:
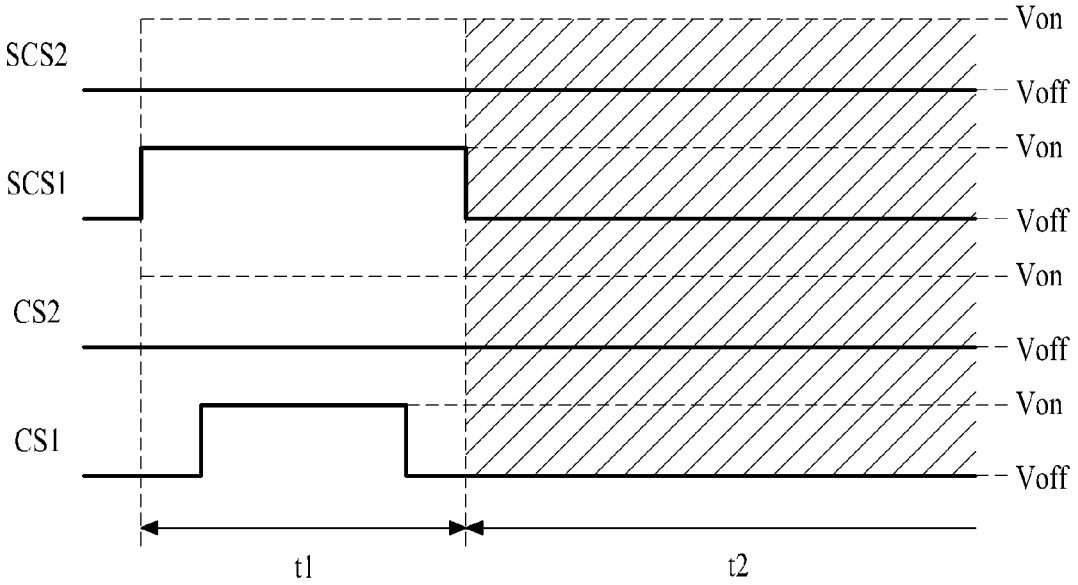

FIGS. 3A and 3B are diagrams for describing a driving method in the display mode for the pixel P illustrated in FIG. 2.

A method of driving the pixel P in the display mode according to an embodiment of the present invention will be described below with reference to FIGS. 3A and 3B. In the display mode, the pixel P may be driven in a data addressing period t1 and an emission period t2.

First, as illustrated in FIG. 3A, in the data addressing period t1, the first switching transistor Tsw1 may be turned on by the scan control signal CS1 of a gate-on voltage Von, the third switching transistor Tsw3 may be turned on by the first sensing control signal SCS1 of the gate-on voltage Von, the second switching transistor Tsw2 may be turned off by the initial control signal CS2 of a gate-off voltage Voff, and the fourth switching transistor Tsw4 may be turned off by the second sensing control signal SCS2 of the gate-off voltage Voff. The data voltage Vdata may be supplied to the data line DL. Here, the threshold voltage (Vth) of the driving transistor Tdr may be stored in the first capacitor C1 in the below-described normal compensation mode or amplification compensation mode.

Therefore, in the data addressing period t1, the organic light emitting diode OLED does not emit light with the reference voltage Vref supplied to the third node n3 according to the turn-on of the third switching transistor Tsw3. Furthermore, when the third switching transistor Tsw3 is turned on and then the first switching transistor Tsw1 is turned on, the data voltage Vdata supplied to the data line DL may be supplied to the first node n1. Thus, the data voltage Vdata may be charged into the second capacitor C2, and a voltage of the second node n2 may increase by the data voltage Vdata according to a voltage of the first node n1.

As a result, in the data addressing period t1, a difference voltage "Vdata−Vref" between the data voltage Vdata and the reference voltage Vref may be stored in the second capacitor C2. A voltage of the first capacitor C1, in which the threshold voltage of the driving transistor Tdr may be stored, may increase by a voltage shift of the first node n1.

Subsequently, as illustrated in FIG. 3B, in the emission period t2, the second and fourth switching transistors Tsw2 and Tsw4 may maintain a turn-off state, the first switching transistor Tsw1 may be turned off by the scan control signal CS1 of the gate-off voltage Voff, and the third switching transistor Tsw3 may be turned off by the first sensing control signal SCS1 of the gate-off voltage Voff.

Therefore, when the first and third switching transistors Tsw1 and Tsw3 are turned off, a current may flow in the driving transistor Tdr, and the organic light emitting diode OLED may start to emit light in proportion to the current. Therefore, a voltage of the third node n3 may increase, and voltages of the first and second nodes n1 and n2 may increase by the increased voltage of the third node n3. Accordingly, the gate-source voltage (Vgs) of the driving transistor Tdr may be continuously maintained by a voltage of the second capacitor C2, and thus, the organic light emitting diode OLED emits light. The emission of light from the organic light emitting diode OLED may be maintained until a next addressing period t1.

Figure 3C:
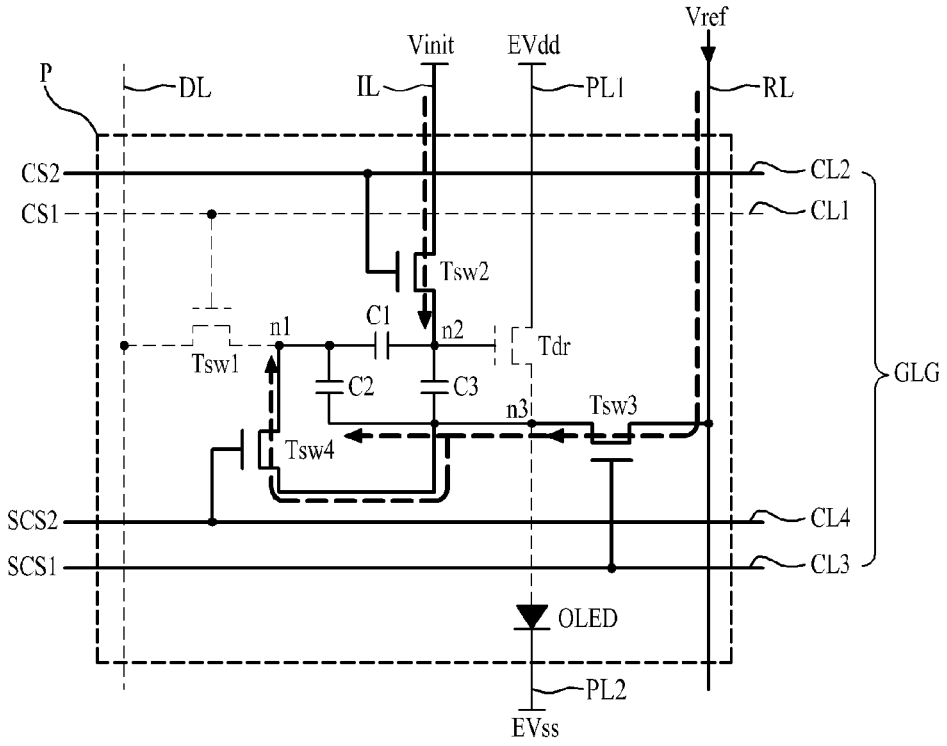
Figure 3C:
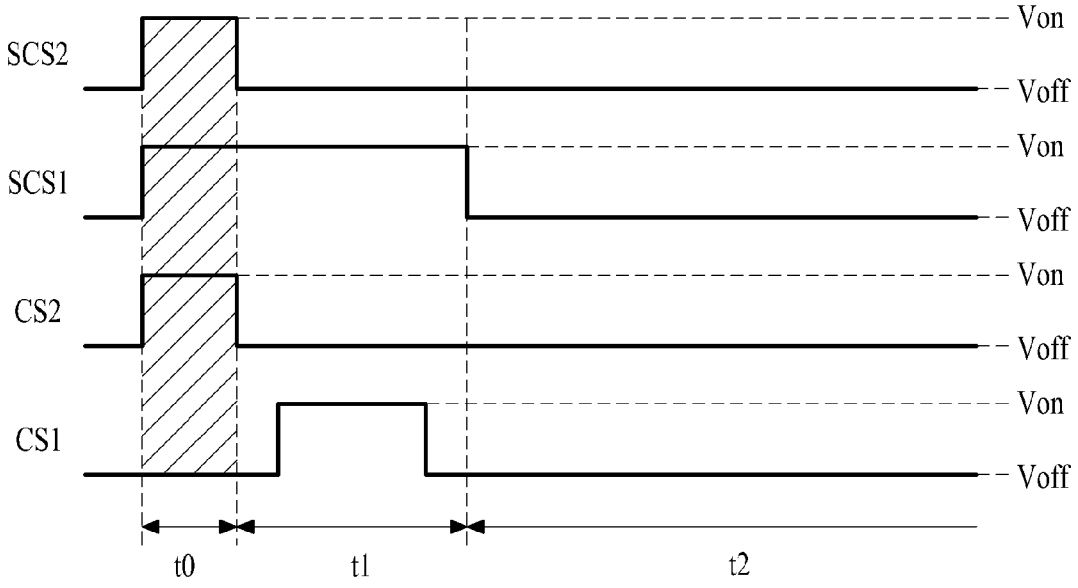

The pixel P based on the display mode may be driven in the below-described external sensing mode. In this case, as illustrated in FIG. 3C, a method of driving the pixel P based on the display mode according to an embodiment of the present invention may further include an initialization period t0, which may be performed before the data addressing period t1.

In the initialization period t0, the first switching transistor Tsw1 may be turned off by the scan control signal CS1 of the gate-off voltage Voff, the second switching transistor Tsw2 may be turned on by the initial control signal CS2 of the gate-on voltage Von, the third switching transistor Tsw3 may be turned on by the first sensing control signal SCS1 of the gate-on voltage Von, and the fourth switching transistor Tsw4 may be turned on by the second sensing control signal SCS2 of the gate-on voltage Von. Therefore, in the initialization period t0, the first and third nodes n1 and n3 may be initialized to the reference voltage Vref, and the second node n2 may be initialized to the initial voltage Vinit.

The reference voltage Vref and the initial voltage Vinit may be voltages that are set for sampling the threshold voltage (Vth) of the driving transistor Tdr, and may have the same voltage level or different voltage levels depending on the threshold voltage of the driving transistor Tdr. For example, when the driving transistor Tdr has a negative threshold voltage, the reference voltage Vref and the initial voltage Vinit may be set to the same voltage level, or the initial voltage Vinit may be set lower than the reference voltage Vref. As another example, when the driving transistor Tdr has a positive threshold voltage, the initial voltage Vinit may be set to a high voltage equal to the positive threshold voltage of the driving transistor Tdr.

In the data addressing period t1 of a method of driving the pixel P (where the method may also include the initialization period t0), the data voltage Vdata supplied to the data line DL may include a compensation voltage. The compensation voltage may be calculated in the external sensing mode—for example, the compensation voltage may be for compensating for the threshold voltage and mobility of the driving transistor Tdr.

FIGS. 4A to 4D are diagrams for describing a driving method in the normal compensation mode for the pixel P illustrated in FIG. 2.

A method of driving the pixel P based on the normal compensation mode according to an embodiment of the present invention will be described below with reference to FIGS. 4A to 4D. In the normal compensation mode, the pixel P may be driven in an initialization period t1, a sampling period t2, a data addressing period t3, and an emission period t4.

Figure 4A:
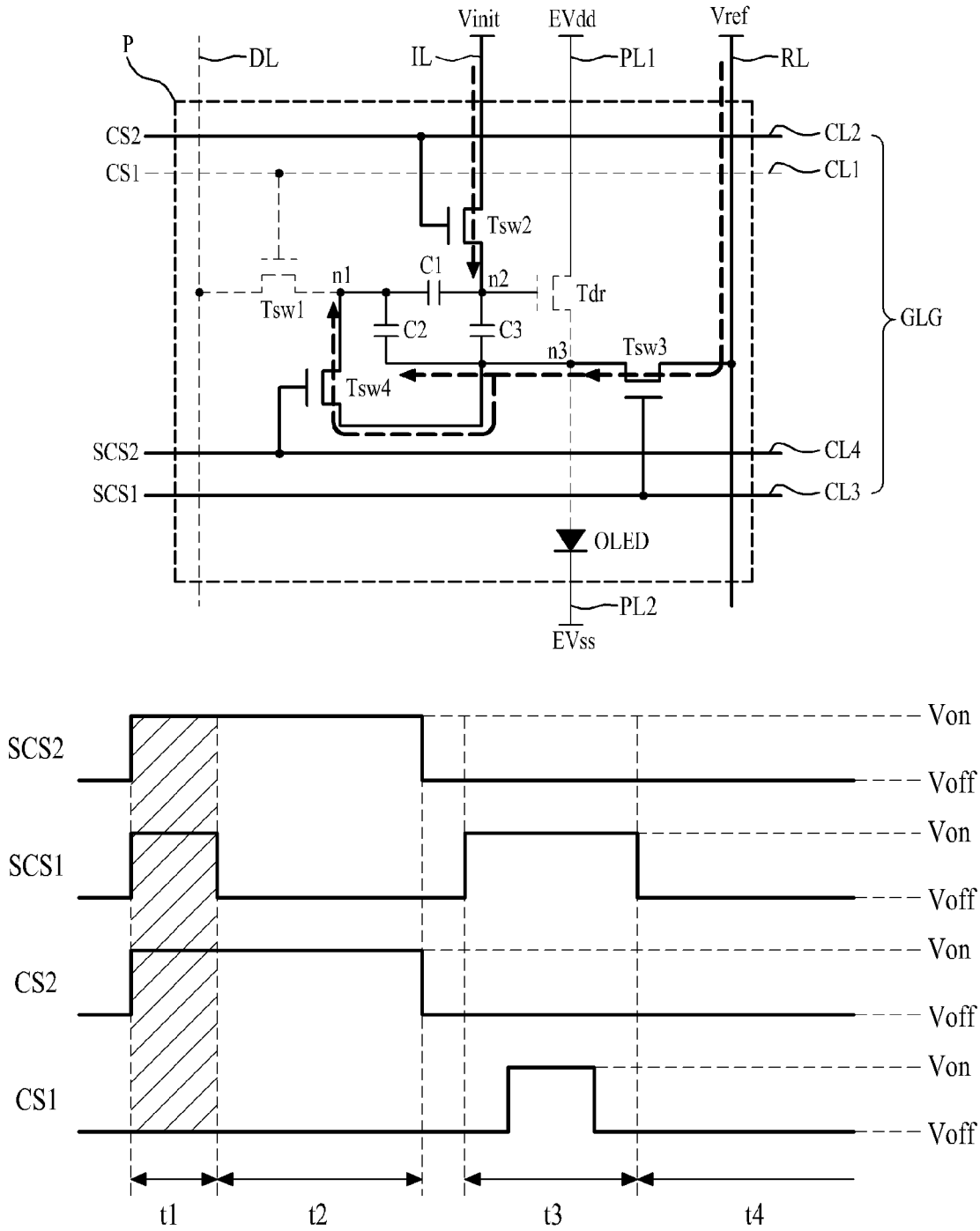
FIGS. 4A to 4D are diagrams for describing a driving method in a normal compensation mode for the pixel illustrated in FIG. 2.

First, as illustrated in FIG. 4A, in the initialization period t1, the first switching transistor Tsw1 may be turned off by the scan control signal CS1 of the gate-off voltage Voff, the second switching transistor Tsw2 may be turned on by the initial control signal CS2 of the gate-on voltage Von, the third switching transistor Tsw3 may be turned on by the first sensing control signal SCS1 of the gate-on voltage Von, and the fourth switching transistor Tsw4 may be turned on by the second sensing control signal SCS2 of the gate-on voltage Von.

Therefore, in the initialization period t1, the first and third nodes n1 and n3 may be initialized to the reference voltage Vref, and the second node n2 may be initialized to the initial voltage Vinit. The initialization period t1 may be the same as the initialization period of the display mode.

Figure 4B:
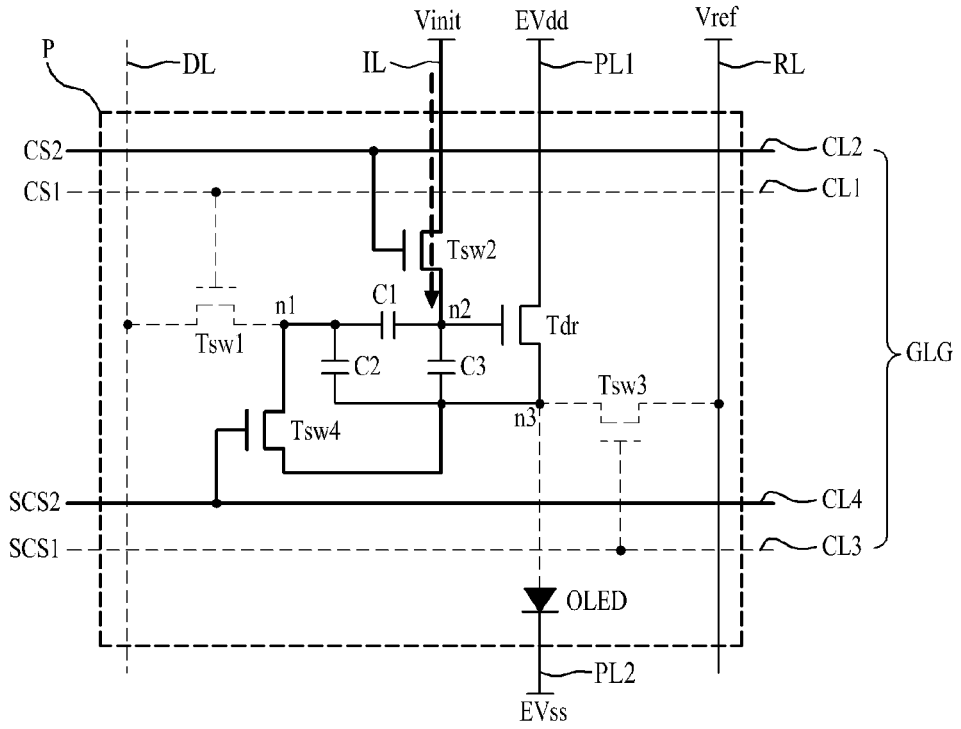
Figure 4B:
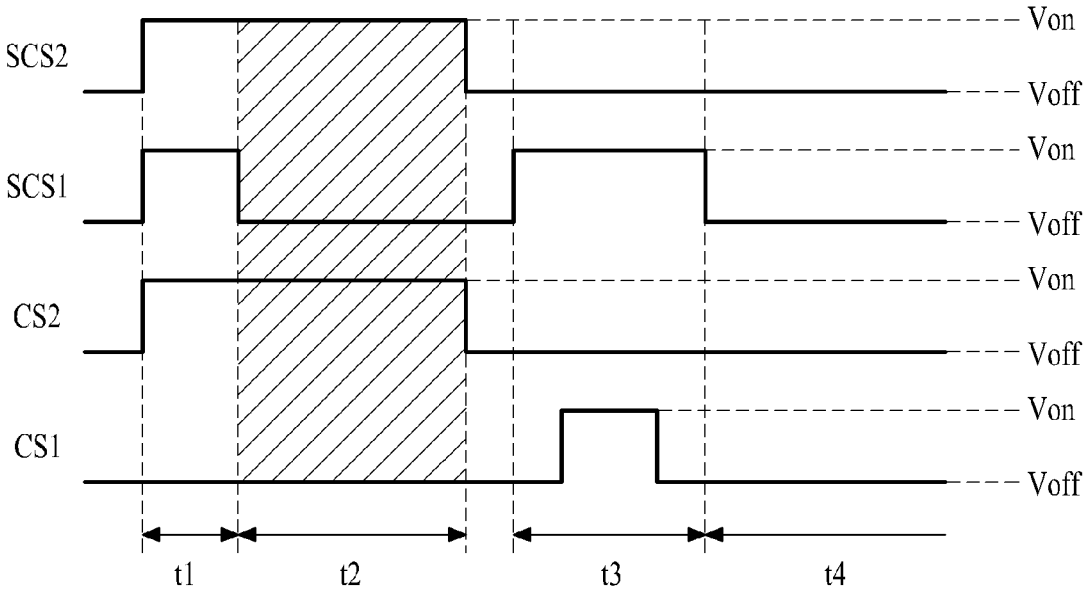

Subsequently, as illustrated in FIG. 4B, in the sampling period t2, the first switching transistor Tsw1 may maintain a turn-off state, the second and fourth switching transistors Tsw2 and Tsw4 may maintain a turn-on state, and the third switching transistor Tsw3 may be turned off by the first sensing control signal SCS1 of the gate-off voltage Voff.

Therefore, in the sampling period t2, the third switching transistor Tsw3 may be turned off, and thus, the driving transistor Tdr may be turned on by a difference voltage "Vinit−Vref" between the second node n2 receiving the initial voltage Vinit and the third node n3. Due to a current which flows in the turned-on driving transistor Tdr, the voltage of the third node n3 may increase until an electrical charge equal to the threshold voltage (Vth) of the driving transistor Tdr may be charged into the third capacitor C3.

Therefore, in the sampling period t2, the voltage of the third node n3 may be a difference voltage "Vinit−Vth" between the initial voltage Vinit and the threshold voltage (Vth) of the driving transistor Tdr, and the voltage of the first node n1 may become equal to the voltage of the third node n3 due to the fourth switching transistor Tsw4 that may maintain a turn-on state. Therefore, only the threshold voltage (Vth) of the driving transistor Tdr, which may be a difference voltage described as "Vinit−Vth-Vinit" between the voltage "Vinit−Vth" of the first node n1 and the voltage Vinit of the second node n2, may be stored in the first capacitor C1. As described above, the threshold voltage (Vth) of the driving transistor Tdr, which may be stored in the first capacitor C1 during the sampling period t2, may be continuously maintained until the initialization period t1 of the normal compensation mode, which may be performed after at least one frame.

Figure 4C:
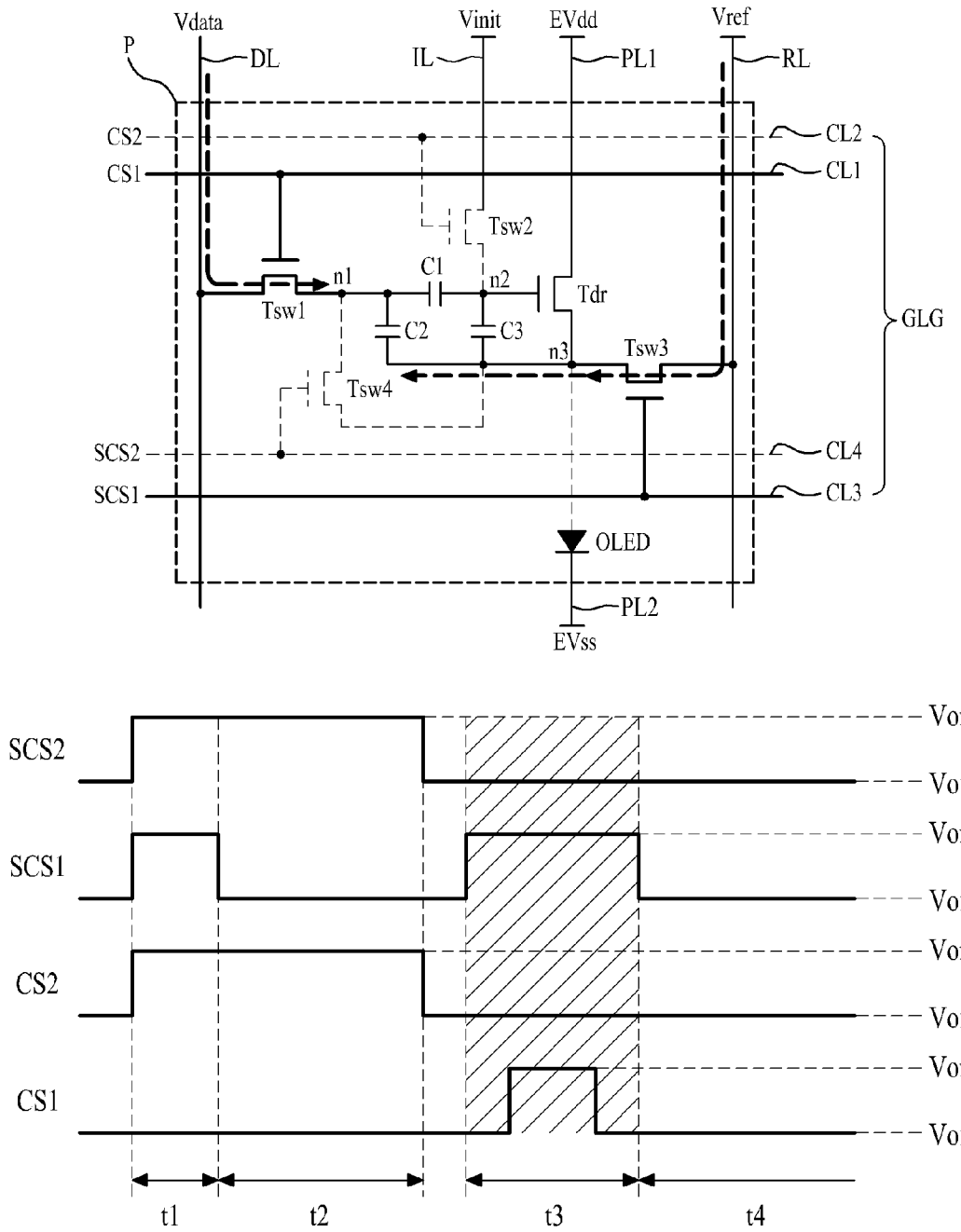

Subsequently, as illustrated in FIG. 4C, in the data addressing period t3, the second switching transistor Tsw2 may be turned off by the initial control signal CS2 of the gate-off voltage Voff, and simultaneously, the fourth switching transistor Tsw4 may be turned off by the second sensing control signal SCS2 of the gate-off voltage Voff. The third switching transistor Tsw3 may be turned on by the first sensing control signal SCS1 of the gate-on voltage Von, and the first switching transistor Tsw1 may be turned on by the scan control signal CS1 of the gate-on voltage Von. The data voltage Vdata may be supplied to the data line DL.

Therefore, in the data addressing period t3, the organic light emitting diode OLED may not emit light with the reference voltage Vref supplied to the third node n3 according to the turn-on of the third switching transistor Tsw3. Furthermore, when the third switching transistor Tsw3 may be turned on and then the first switching transistor Tsw1 may be turned on, the data voltage Vdata supplied to the data line DL may be supplied to the first node n1. Thus, the data voltage Vdata may be charged into the second capacitor C2, and a voltage of the second node n2 may increase by the data voltage Vdata according to a voltage of the first node n1.

As a result, in the data addressing period t3, a difference voltage "Vdata−Vref" between the data voltage Vdata and the reference voltage Vref may be stored in the second capacitor C2. A sum voltage "Vdata+Vth" of the data voltage Vdata and the driving voltage (Vth) of the driving transistor (which may be stored in the sampling period t2) may be stored in the first capacitor C1.

Figure 4D:
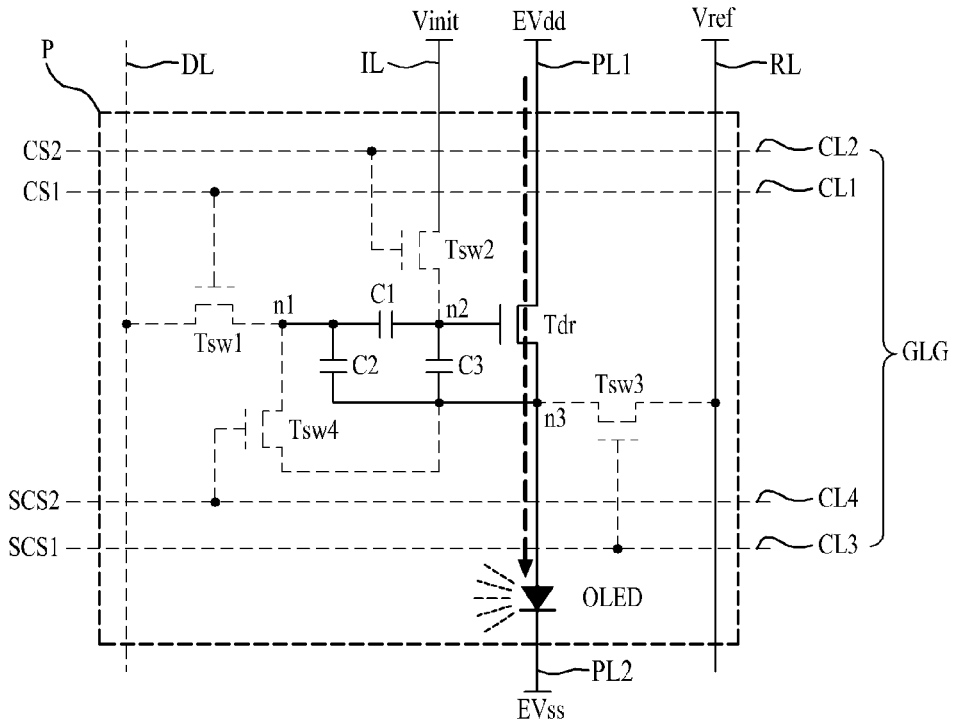
Figure 4D:
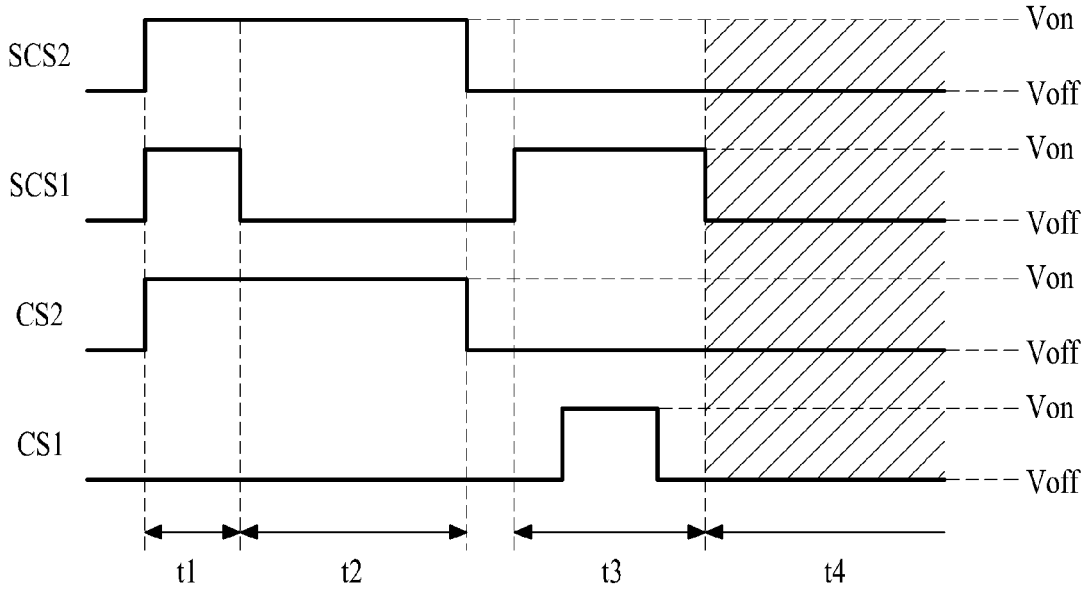

Subsequently, as illustrated in FIG. 4D, in the emission period t4, the second and fourth switching transistors Tsw2 and Tsw4 may maintain a turn-off state, the first switching transistor Tsw1 may be turned off by the scan control signal CS1 of the gate-off voltage Voff, and the third switching transistor Tsw3 may be turned off by the first sensing control signal SCS1 of the gate-off voltage Voff.

Therefore, when the first and third switching transistors Tsw1 and Tsw3 are turned off, a current may flow in the driving transistor Tdr, and the organic light emitting diode OLED may start to emit light in proportion to the current. Therefore, a voltage of the third node n3 may increase, and voltages of the first and second nodes n1 and n2 increase by the increased voltage of the third node n3. Accordingly, the gate-source voltage (Vgs) of the driving transistor Tdr may be continuously maintained by a voltage of the second capacitor C2, and thus, the organic light emitting diode OLED emits light.

FIGS. 5A to 5F are diagrams for describing a driving method in the amplification compensation mode for the pixel P illustrated in FIG. 2.

A method of driving the pixel P based on the amplification compensation mode according to an embodiment of the present invention will be described below with reference to FIGS. 5A to 5F. In the amplification compensation mode, the pixel P may be driven in an initialization period t1, a sampling period t2, a data addressing period t3, and an emission period t4. Here, the sampling period t2 may include first to third sub sampling periods t2-1, t2-2 and t2-3.

Figure 5A:
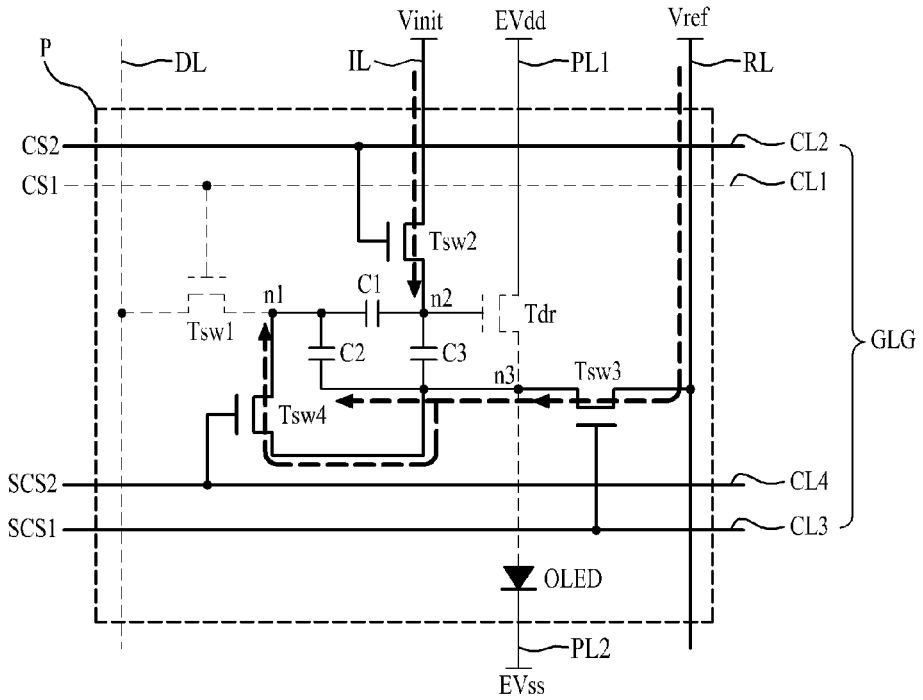
FIGS. 5A to 5F are diagrams for describing a driving method in an amplification compensation mode for the pixel illustrated in FIG. 2.
Figure 5A:
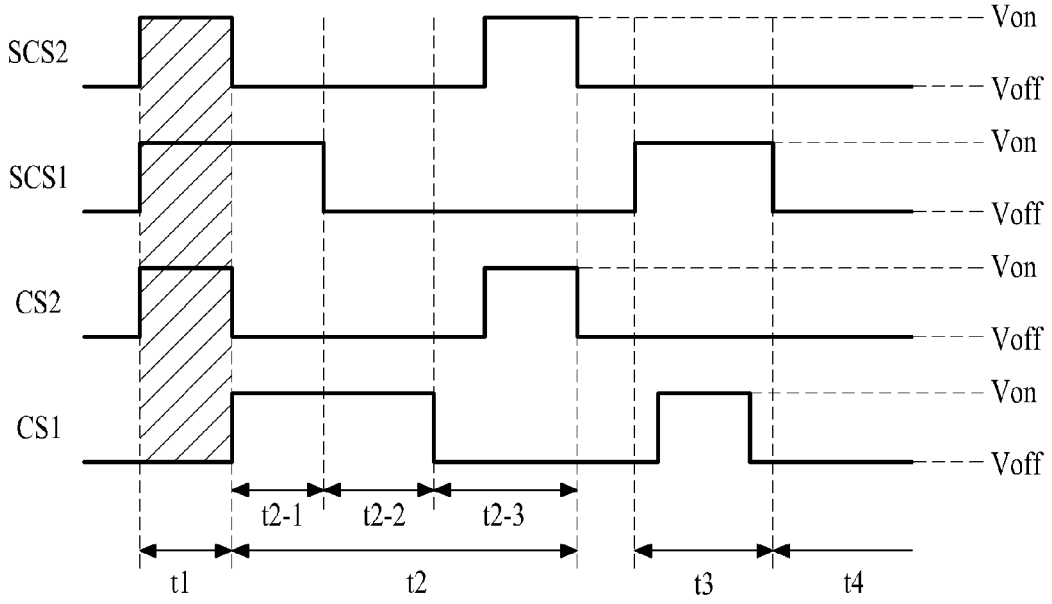

First, as illustrated in FIG. 5A, in the initialization period t1, the first switching transistor Tsw1 may be turned off by the scan control signal CS1 of the gate-off voltage Voff, the second switching transistor Tsw2 may be turned on by the initial control signal CS2 of the gate-on voltage Von, the third switching transistor Tsw3 may be turned on by the first sensing control signal SCS1 of the gate-on voltage Von, and the fourth switching transistor Tsw4 may be turned on by the second sensing control signal SCS2 of the gate-on voltage Von. Therefore, in the initialization period t1, the first and third nodes n1 and n3 may be initialized to the reference voltage Vref, and the second node n2 may be initialized to the initial voltage Vinit.

Figure 5B:
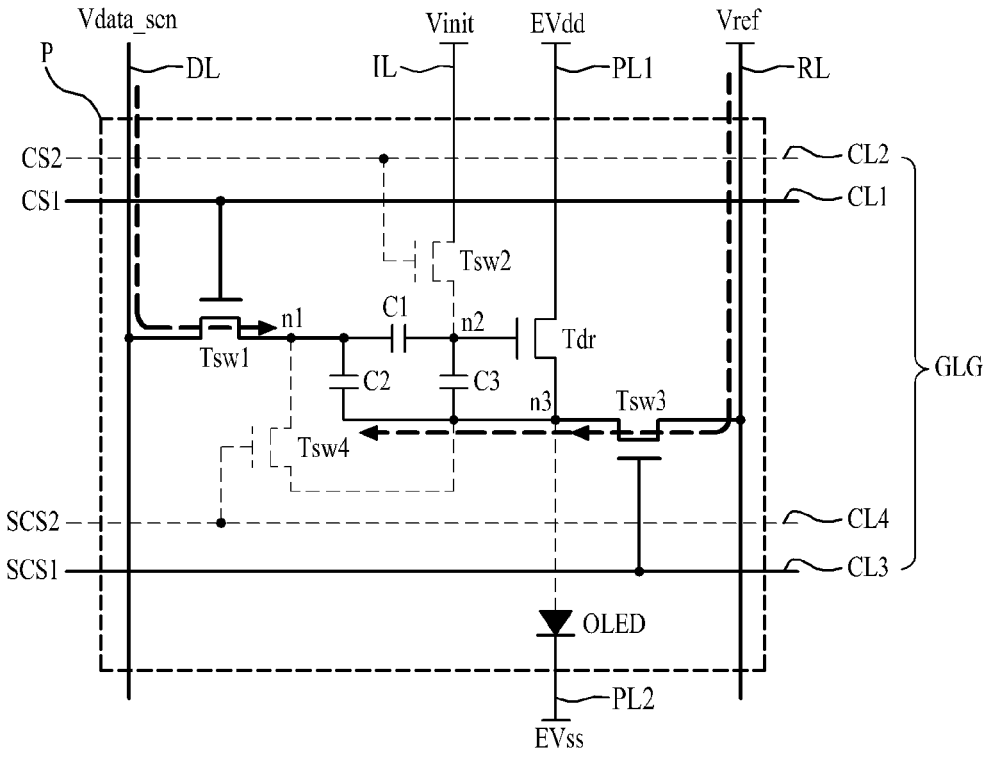
Figure 5B:
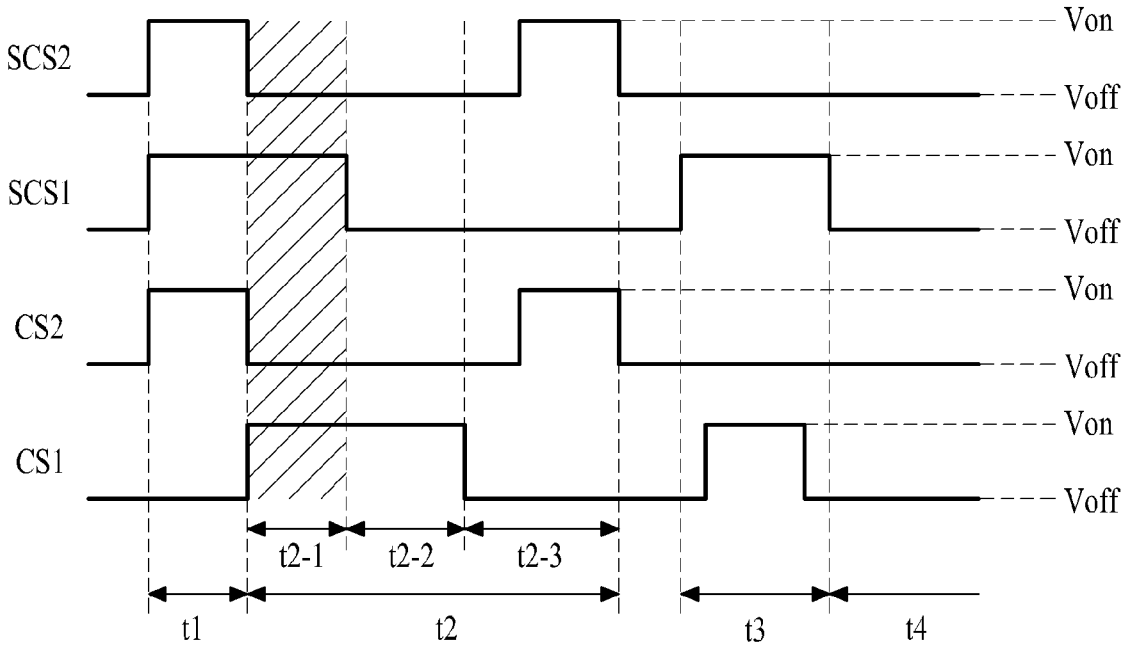

Subsequently, as illustrated in FIG. 5B, in the first sub sampling period t2-1 of the sampling period t2, the first switching transistor Tsw1 may be turned on by the scan control signal CS1 of the gate-on voltage Von, the third switching transistor Tsw3 may maintain a turn-on state, the second switching transistor Tsw2 may be turned off by the initial control signal CS2 of the gate-off voltage Voff, and the fourth switching transistor Tsw4 may be turned off by the second sensing control signal SCS2 of the gate-off voltage Voff. A sensing data voltage Vdata_sen may be supplied to the data line DL. Therefore, in the first sub sampling period t2-1, because the second and fourth switching transistors Tsw2 and Tsw4 are turned off and the first switching transistor Tsw1 is turned on, the voltage of the first node n1 may be shifted from the reference voltage Vref to the sensing data voltage Vdata_sen, and the voltage of the second node n2 may increase by the sensing data voltage Vdata_sen according to the voltage shift of the first node n1. Accordingly, a sum voltage "Vdata_sen+Vinit−Vref" of the sensing data voltage Vdata_sen and a difference voltage "Vinit−Vref" between the initial voltage Vinit and the reference voltage Vref may be charged into the second and third capacitors C2 and C3. At this time, the organic light emitting diode OLED does not emit light with the reference voltage Vref which may be supplied to the third node n3 through the third switching transistor Tsw3.

Figure 5C:
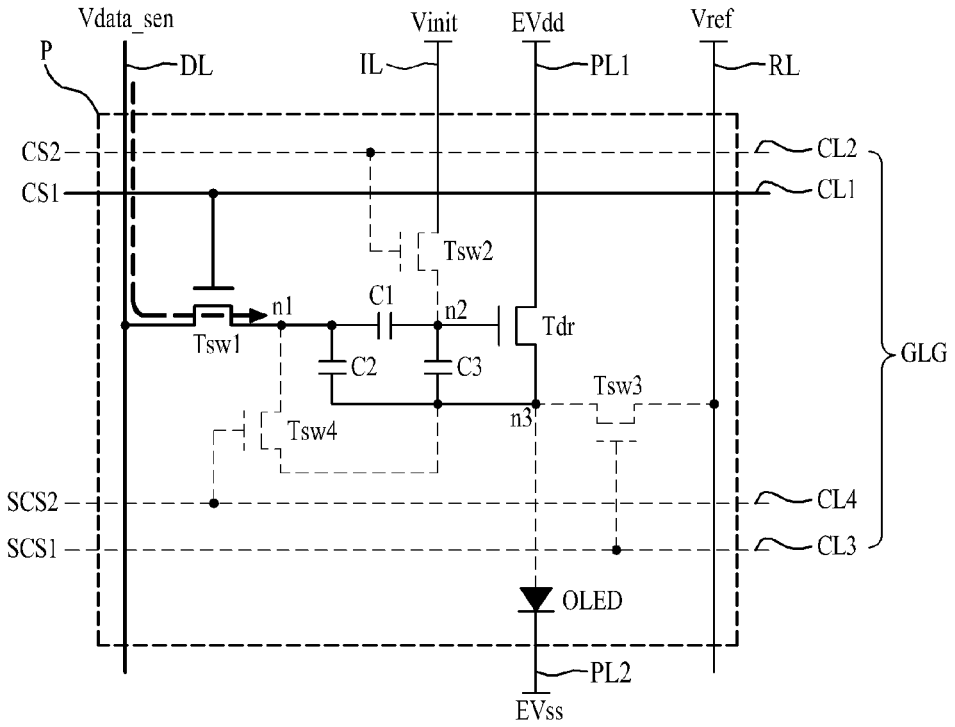
Figure 5C:
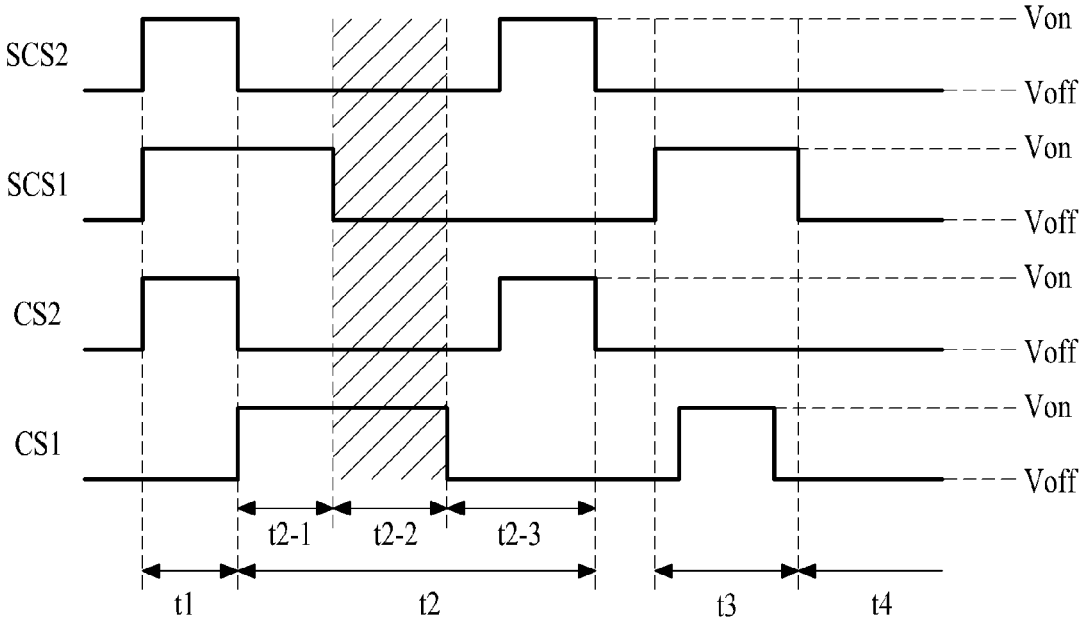

Subsequently, as illustrated in FIG. 5C, in the second sub sampling period t2-2 of the sampling period t2, the second and fourth switching transistors Tsw2 and Tsw4 may maintain a turn-off state, the first switching transistor Tsw1 may maintain a turn-on state, and the third switching transistor Tsw3 may be turned off by the first sensing control signal SCS1 of the gate-off voltage Voff. Therefore, in the second sub sampling period t2-2, because the third switching transistor Tsw3 may be turned off, the driving transistor Tdr may be turned on by the sensing data voltage Vdata_sen supplied to the first node n1 and the voltages of the first to third capacitors C1 to C3. Furthermore, due to a current which flows in the turned-on driving transistor Tdr, the voltage of the third node n3 may increase until an electrical charge equal to the threshold voltage (Vth) of the driving transistor Tdr is charged into the second and third capacitors C2 and C3. Accordingly, the threshold voltage (Vth) of the driving transistor Tdr may be stored in the second and third capacitors C2 and C3.

Figure 5D:
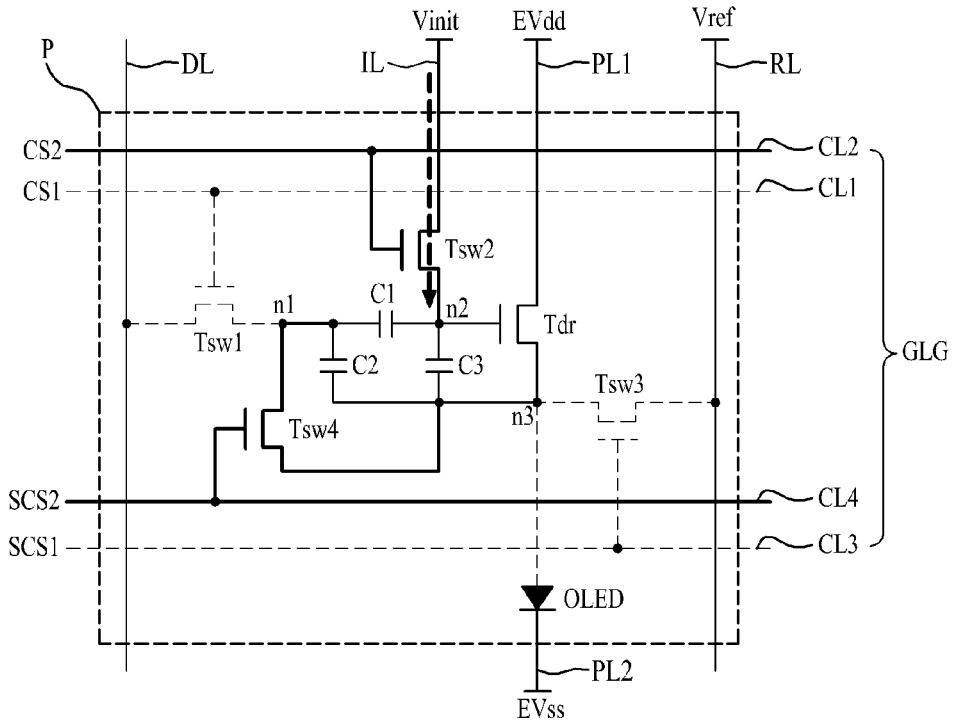
Figure 5D:
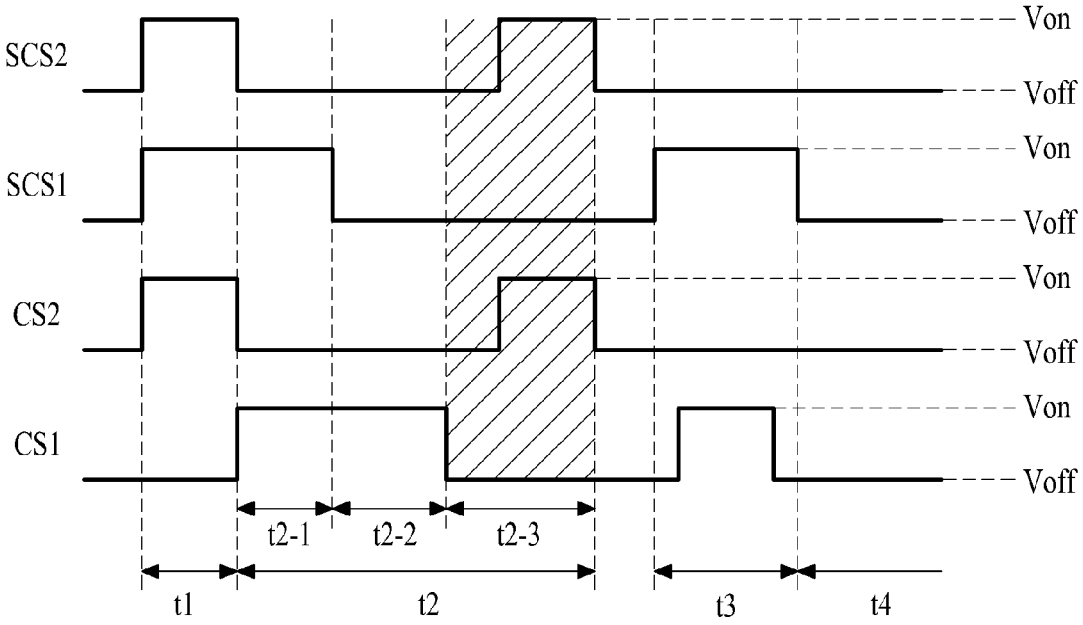

Subsequently, as illustrated in FIG. 5D, in the third sub sampling period t2-3 of the sampling period t2, the third switching transistor Tsw3 may maintain a turn-off state, the first switching transistor Tsw1 may be turned off by the scan control signal CS1 of the gate-off voltage Voff, the second switching transistor Tsw2 may be turned on by the initial control signal CS2 of the gate-on voltage Von, and the fourth switching transistor Tsw4 may be turned on by the second sensing control signal SCS2 of the gate-on voltage Von. Therefore, in the third sub sampling period t2-3, because the second and fourth switching transistors Tsw2 and Tsw4 are turned on, the first and third nodes n1 and n3 are connected to each other through the turned-on fourth switching transistor Tsw4, and thus, the threshold voltage (Vth) of the driving transistor Tdr which may be stored in the second and third capacitors C2 and C3 may be transferred to the first capacitor C1. Accordingly, only the threshold voltage (Vth) of the driving transistor Tdr may be stored in the first capacitor C1. The threshold voltage (Vth) of the driving transistor Tdr which may be stored in the first capacitor C1 during the sampling period t2 may be continuously maintained until being updated in the sampling period t2 after at least one frame.

Figure 5E:
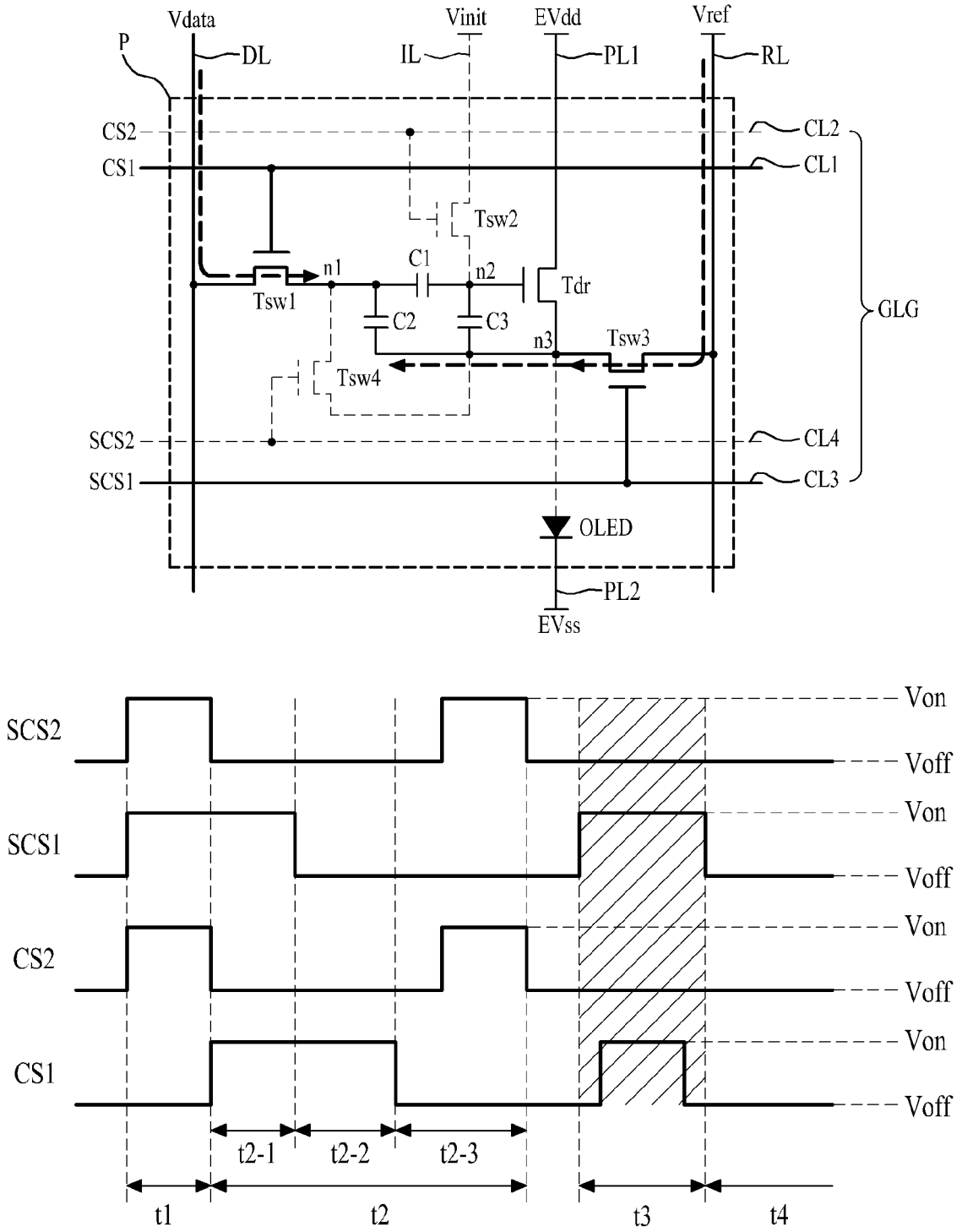

Subsequently, as illustrated in FIG. 5E, in the data addressing period t3, the second switching transistor Tsw2 may be turned off by the initial control signal CS2 of the gate-off voltage Voff, and simultaneously, the fourth switching transistor Tsw4 may be turned off by the second sensing control signal SCS2 of the gate-off voltage Voff. The third switching transistor Tsw3 may be turned on by the first sensing control signal SCS1 of the gate-on voltage Von, and the first switching transistor Tsw1 may be turned on by the scan control signal CS1 of the gate-on voltage Von. Therefore, in the data addressing period t3, the organic light emitting diode OLED may not emit light with the reference voltage Vref supplied to the third node n3 according to the turn-on of the third switching transistor Tsw3.

Furthermore, when the third switching transistor Tsw3 is turned on and then the first switching transistor Tsw1 is turned on, the data voltage Vdata supplied to the data line DL may be supplied to the first node n1. Thus, the data voltage Vdata may be charged into the second capacitor C2, and a voltage of the second node n2 may increase by the data voltage Vdata according to a voltage of the first node n1. As a result, in the data addressing period t3, a difference voltage "Vdata−Vref" between the data voltage Vdata and the reference voltage Vref may be stored in the second capacitor C2. A sum voltage "Vdata+Vth" of the data voltage Vdata and the threshold voltage (Vth) of the driving transistor (which may be stored in the sampling period t2) may be stored in the first capacitor C1.

Figure 5F:
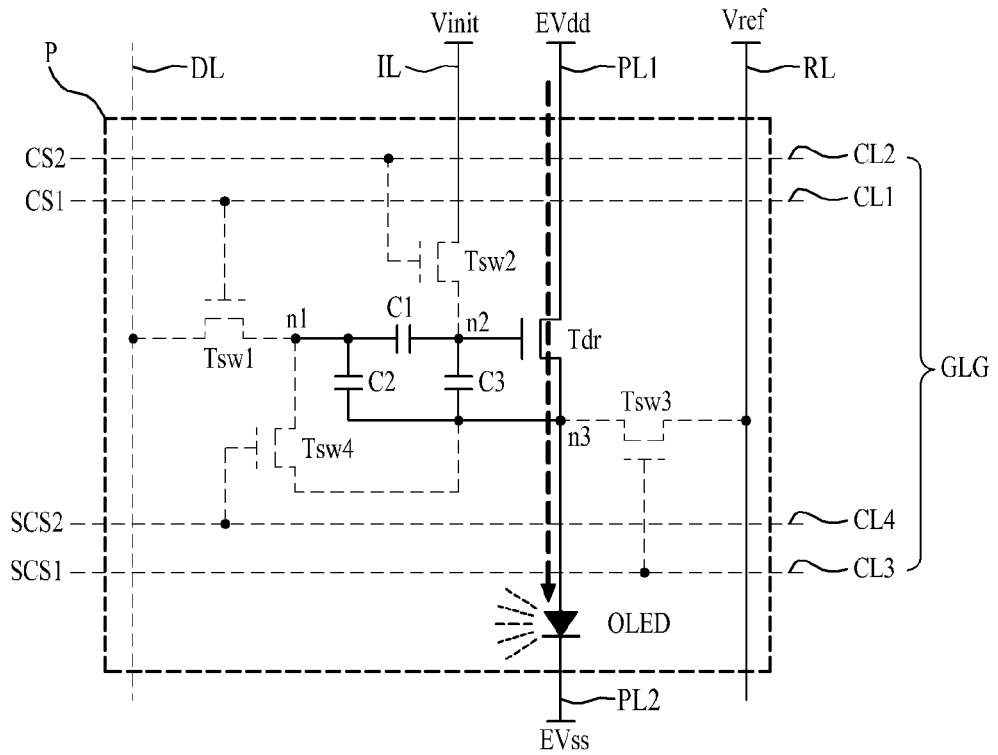
Figure 5F:
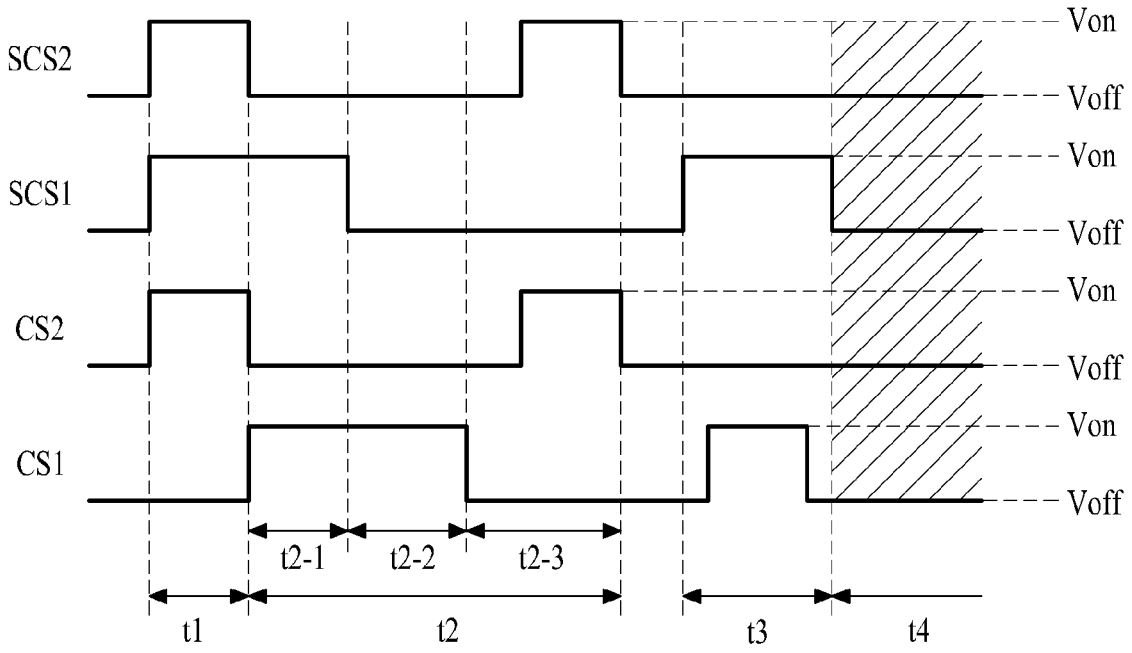

Subsequently, as illustrated in FIG. 5F, in the emission period t4, the second and fourth switching transistors Tsw2 and Tsw4 may maintain a turn-off state, the first switching transistor Tsw1 may be turned off by the scan control signal CS1 of the gate-off voltage Voff, and the third switching transistor Tsw3 may be turned off by the first sensing control signal SCS1 of the gate-off voltage Voff. Therefore, when the first and third switching transistors Tsw1 and Tsw3 are turned off, a current may flow in the driving transistor Tdr, and the organic light emitting diode OLED may start to emit light in proportion to the current. Therefore, a voltage of the third node n3 may increase, and voltages of the first and second nodes n1 and n2 increase by the increased voltage of the third node n3. Accordingly, the gate-source voltage (Vgs) of the driving transistor Tdr may be continuously maintained by a voltage of the second capacitor C2, and thus, the organic light emitting diode OLED emits light.

FIGS. 6A to 6F are diagrams for describing a driving method in the external sensing mode for the pixel P illustrated in FIG. 2.

A method of driving the pixel P based on the external sensing mode according to an embodiment of the present invention will be described below with reference to FIGS. 6A to 6F. In the external sensing mode, the pixel P may be driven in an initialization period t1 and a first sensing period t2. Here, the first sensing period t2 may include a floating period t2-1 and a threshold voltage sensing period t2-2.

Figure 6A:
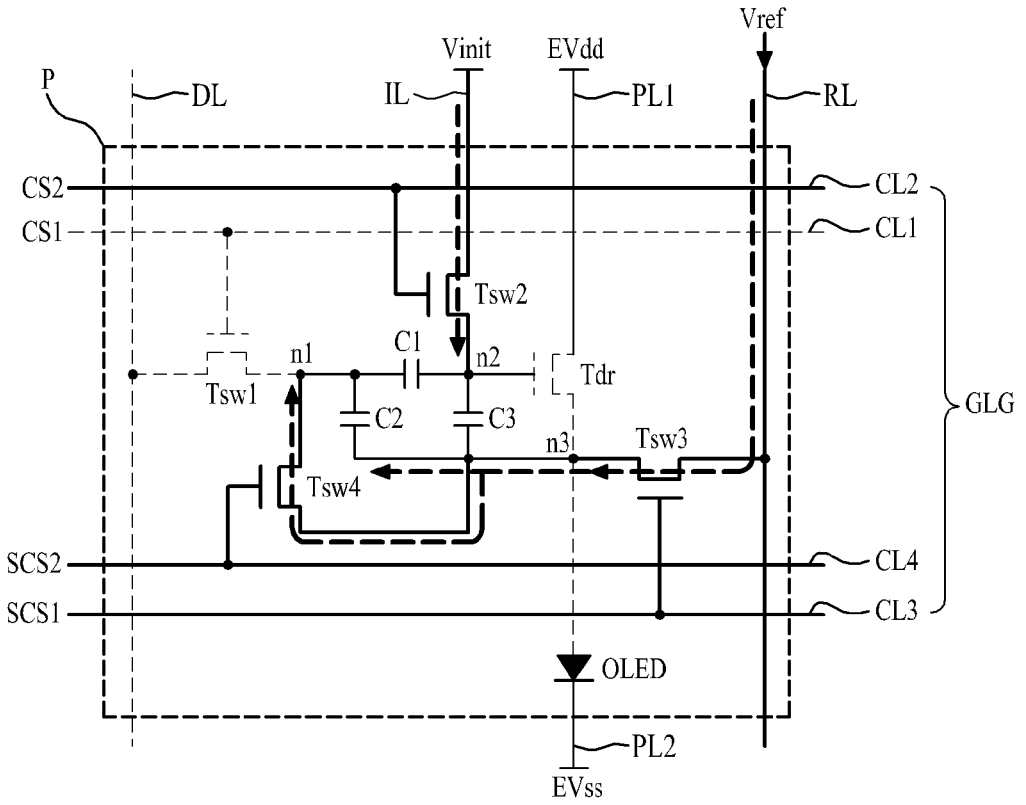
FIGS. 6A to 6F are diagrams for describing a driving method in an external sensing mode for the pixel illustrated in FIG. 2.
Figure 6A:
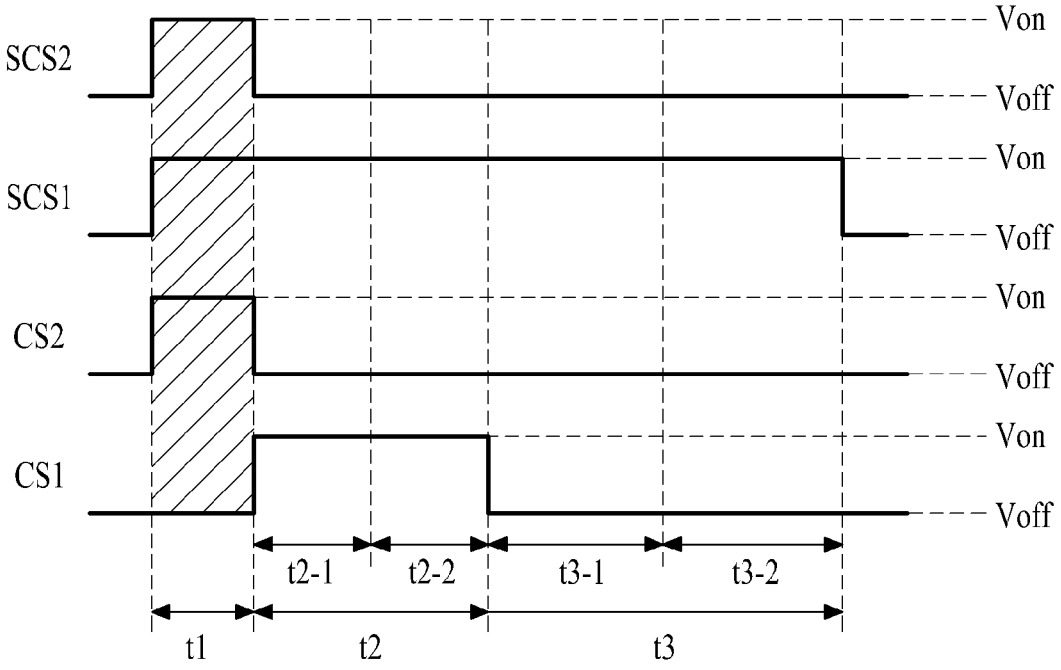

First, as illustrated in FIG. 6A, in the initialization period t1, the first switching transistor Tsw1 may be turned off by the scan control signal CS1 of the gate-off voltage Voff, the second switching transistor Tsw2 may be turned on by the initial control signal CS2 of the gate-on voltage Von, the third switching transistor Tsw3 may be turned on by the first sensing control signal SCS1 of the gate-on voltage Von, and the fourth switching transistor Tsw4 may be turned on by the second sensing control signal SCS2 of the gate-on voltage Von.

Therefore, in the initialization period t1, the first and third nodes n1 and n3 may be initialized to the reference voltage Vref, and the second node n2 may be initialized to the initial voltage Vinit.

Figure 6B:
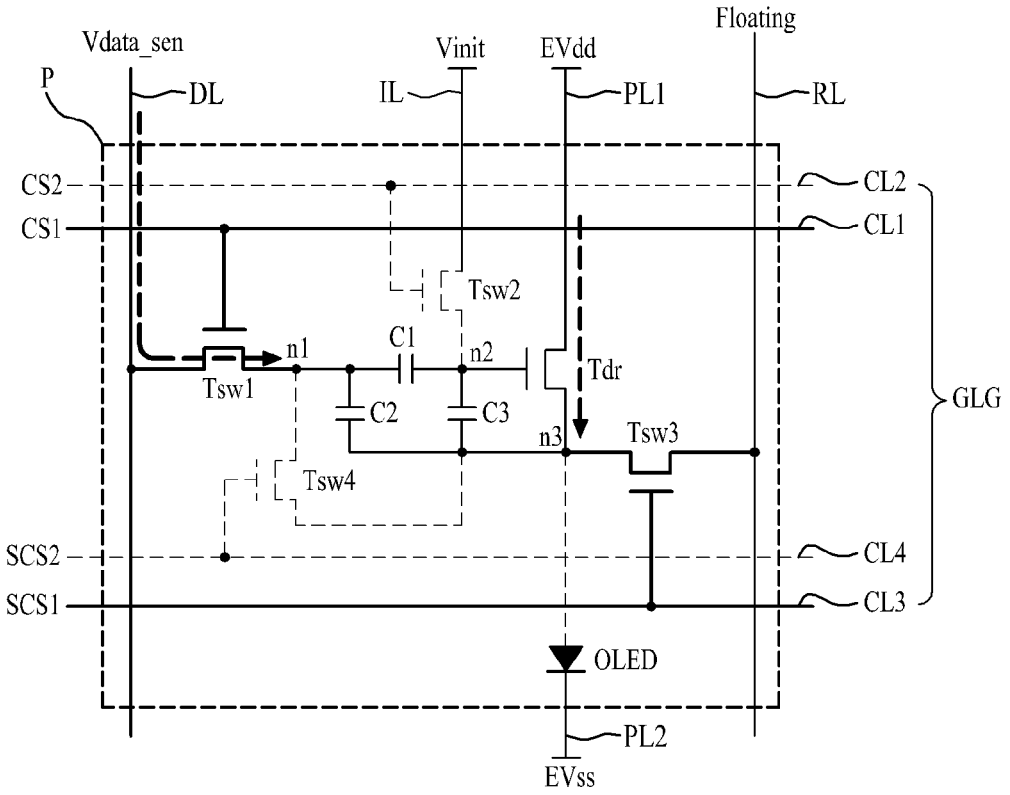
Figure 6B:
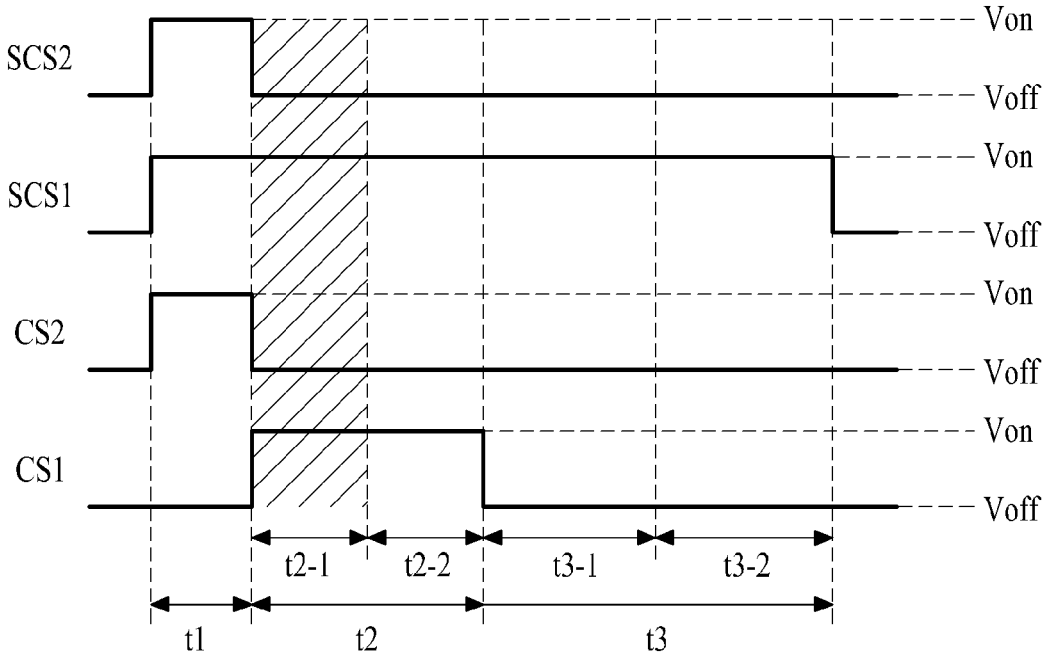

Subsequently, as illustrated in FIG. 6B, in the floating period t2-1 of the first sensing period t2, the first switching transistor Tsw1 may be turned on by the scan control signal CS1 of the gate-on voltage Von, the third switching transistor Tsw3 may maintain a turn-on state, the second switching transistor Tsw2 may be turned off by the initial control signal CS2 of the gate-off voltage Voff, and the fourth switching transistor Tsw4 may be turned off by the second sensing control signal SCS2 of the gate-off voltage Voff. A sensing data voltage Vdata_sen, which may be a bias voltage for driving the driving transistor Tdr in a source follower mode, may be supplied to the data line DL. The reference line RL may be changed to a floating state.

Therefore, in the floating period t2-1, because the second and fourth switching transistors Tsw2 and Tsw4 are turned off and the first switching transistor Tsw1 may be turned on, the voltage of the first node n1 may be shifted to the sensing data voltage Vdata_sen, and the voltage of the second node n2 may be shifted by a voltage corresponding to the voltage shift of the first node n1, whereby the driving transistor Tdr may be driven in the source follower mode. Accordingly, the voltage of the third node n3 may increase by a difference voltage "Vdata_sen-Vth" between the threshold voltage (Vth) of the driving transistor Tdr and the sensing data voltage Vdata_sen, and only the threshold voltage (Vth) of the driving transistor Tdr, which may be a difference voltage "Vdata_sen-Vdata-Vth" between the sensing data voltage Vdata_sen and the voltage "Vdata_sen-Vth" of the third node n3, may be stored in the second capacitor C2.

Figure 6C:
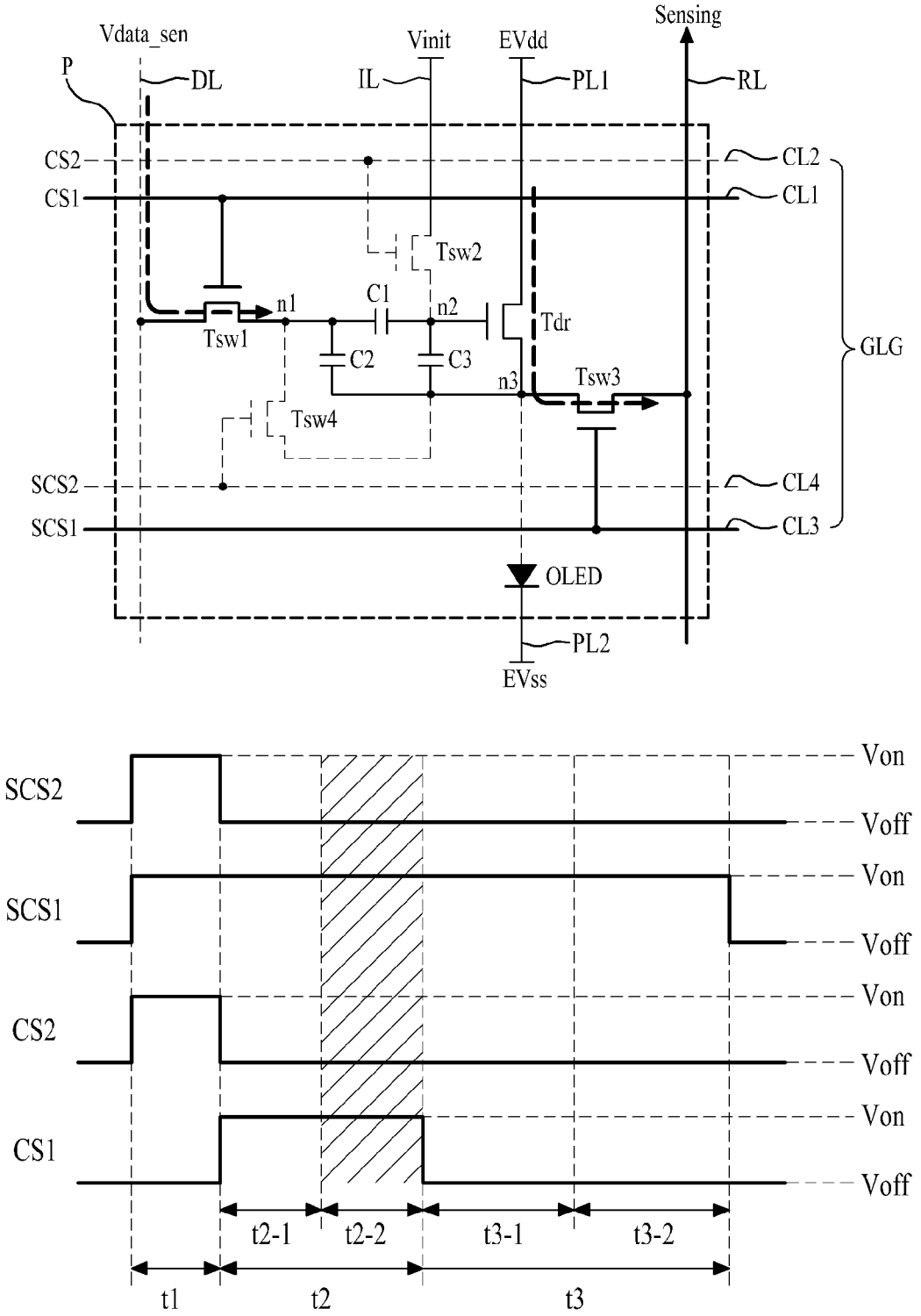

Subsequently, as illustrated in FIG. 6C, in the threshold voltage sensing period t2-2 of the first sensing period t2, the first and third switching transistors Tsw1 and Tsw3 may maintain a turn-on state, and the second and fourth switching transistors Tsw2 and Tsw4 may maintain a turn-off state. Furthermore, when the sensing data voltage Vdata_sen is being continuously supplied to the data line DL, the reference line RL may be connected to an analog-to-digital converter (ADC, not shown) of a sensing unit (not shown).

Therefore, in the threshold voltage sensing period t2-2, because the driving transistor Tdr operates in the source follower mode, a voltage corresponding to a current which flows in the driving transistor Tdr may be charged into the reference line RL, and at a specific time, the ADC of the sensing unit may sense (or sample) the voltage of the reference line RL and perform analog-digital conversion to generate threshold voltage sensing data.

The threshold voltage sensing data may be supplied to a timing controller (not shown) of the organic light emitting display device, and the timing controller may calculate a threshold voltage shift of the driving transistor Tdr on the basis of the threshold voltage sensing data of a pixel, calculate threshold voltage compensation data used to compensate for the threshold voltage shift, and correct input data on the basis of the threshold voltage compensation data in the display mode, thereby compensating for the threshold voltage of the driving transistor Tdr through data correction.

Figure 6D:
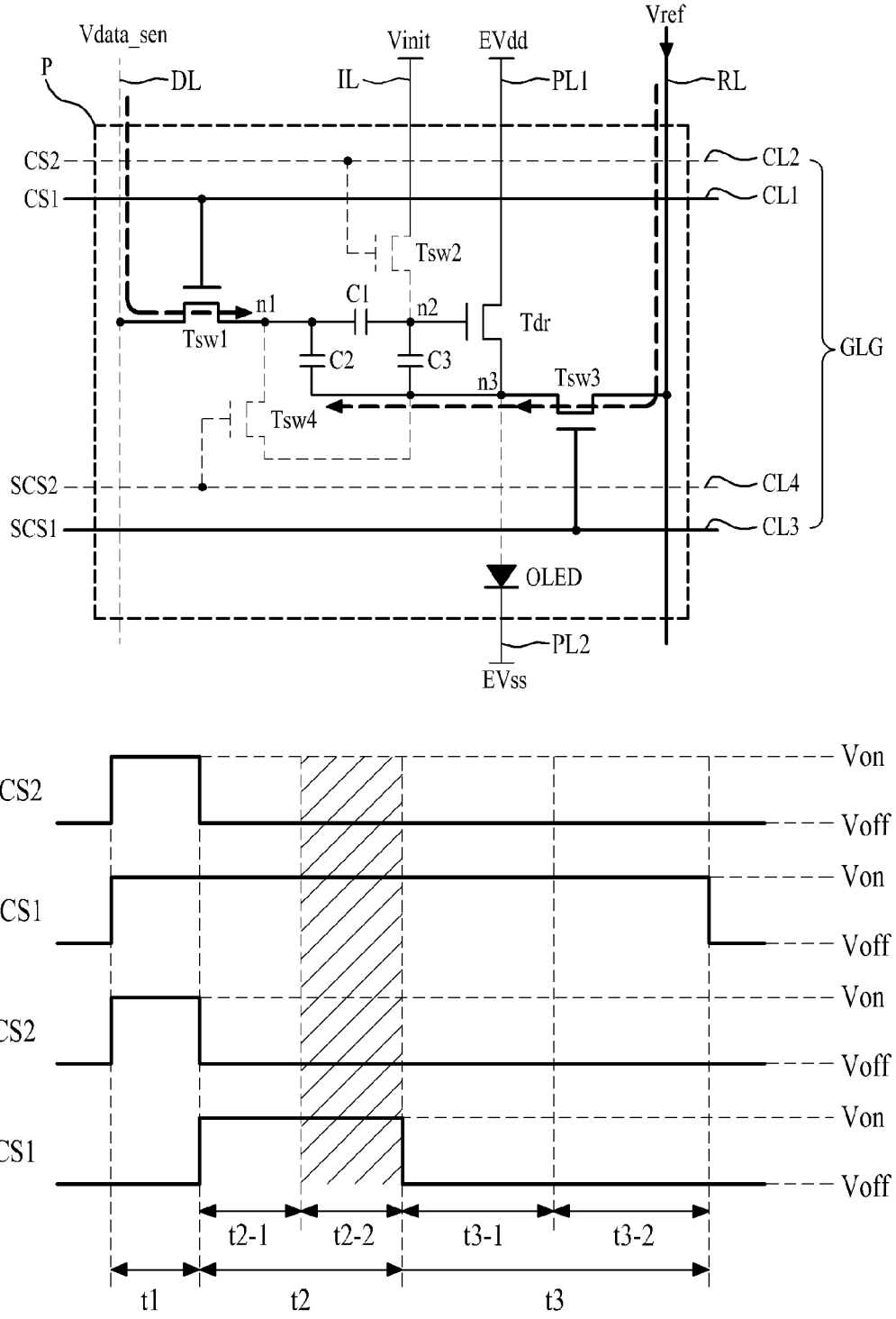

At the specific time when the sensing driving of the sensing unit is completed for the voltage of the reference line RL, as illustrated in FIG. 6D, the reference voltage Vref may be supplied to the reference line RL. Therefore, a difference voltage "Vdata_sen−Vref" between the sensing data voltage Vdata_sen and the reference voltage Vref may be stored in the second capacitor C2, and thus, the threshold voltage (Vth) of the driving transistor Tdr which may be stored in the second capacitor C2 is removed.

In the external sensing mode, the pixel P may be driven in a sensing period t3 for sensing a mobility of the driving transistor Tdr after the first sensing period t2. Here, the second sensing period t3 may include a sensing voltage charging period t3-1 and a mobility sensing period t3-2.

Figure 6E:
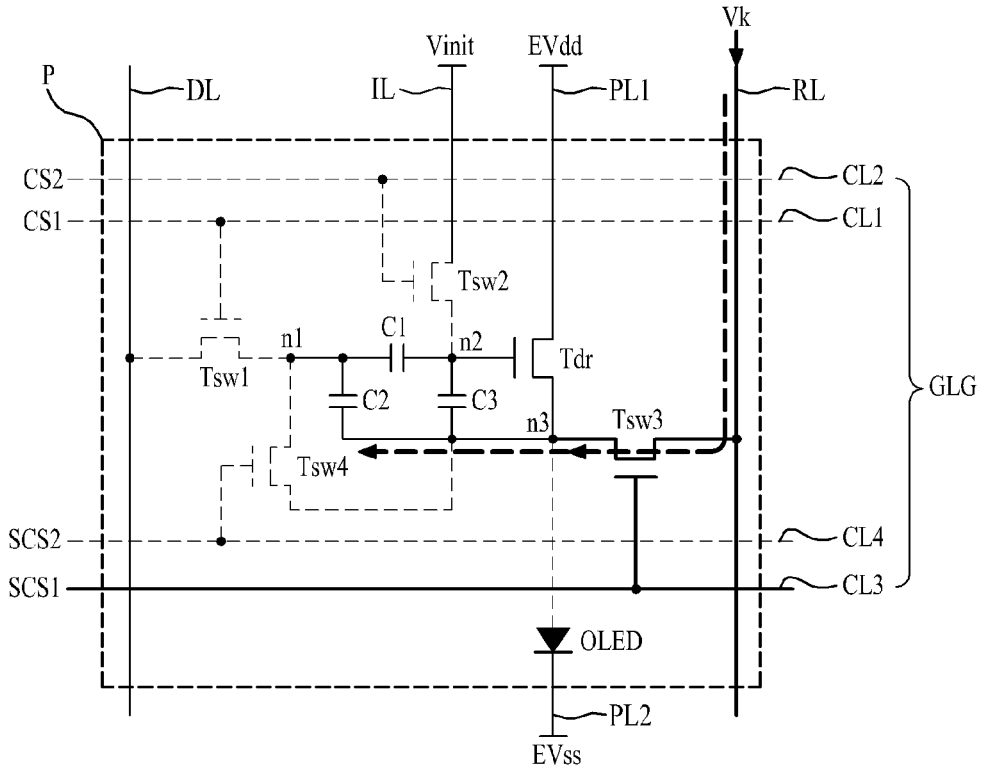
Figure 6E:
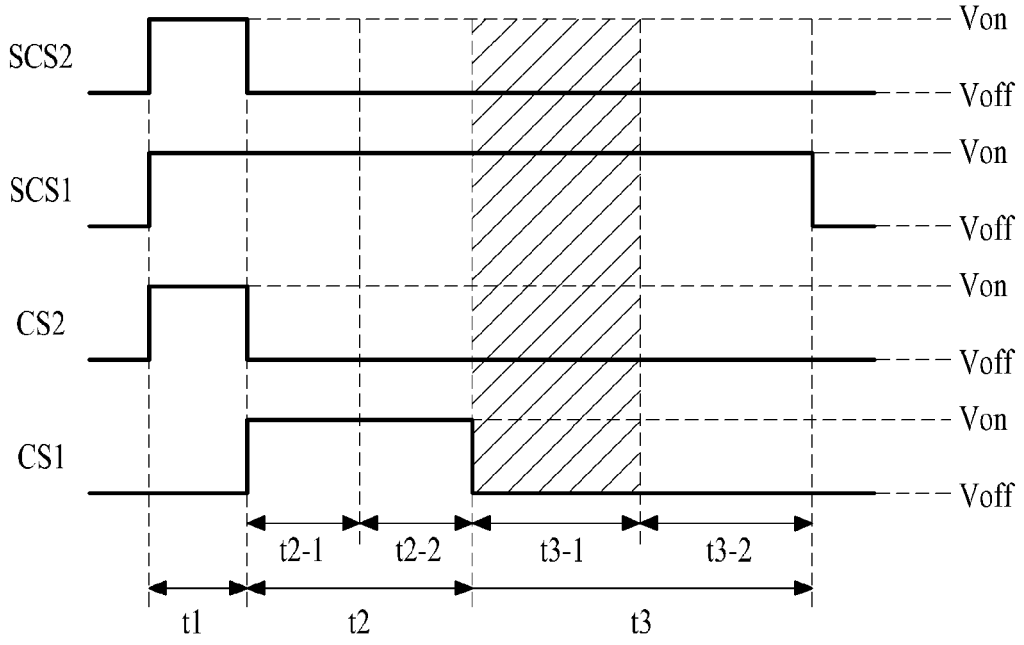

As illustrated in FIG. 6E, in the sensing voltage charging period t3-1 of the second sensing period t3, the second and fourth switching transistors Tsw2 and Tsw4 may maintain a turn-off state, the third switching transistor Tsw3 may maintain a turn-on state, the first switching transistor Tsw1 may be turned off by the scan control signal CS1 of the gate-off voltage Voff, and a mobility sensing voltage Vk may be supplied to the reference line RL.

Therefore, because the first switching transistor Tsw1 may be turned off, the voltage of the third node n3 may be shifted to the mobility sensing voltage Vk, and the voltages of the first and second nodes n1 and n2 may be shifted by a voltage corresponding to the voltage shift of the third node n3. Accordingly, the first capacitor C1 may be initialized to 0V, and the difference voltage "Vdata_sen−Vref" between the sensing data voltage Vdata_sen and the reference voltage Vref may be stored in the second capacitor C2.

Figure 6F:
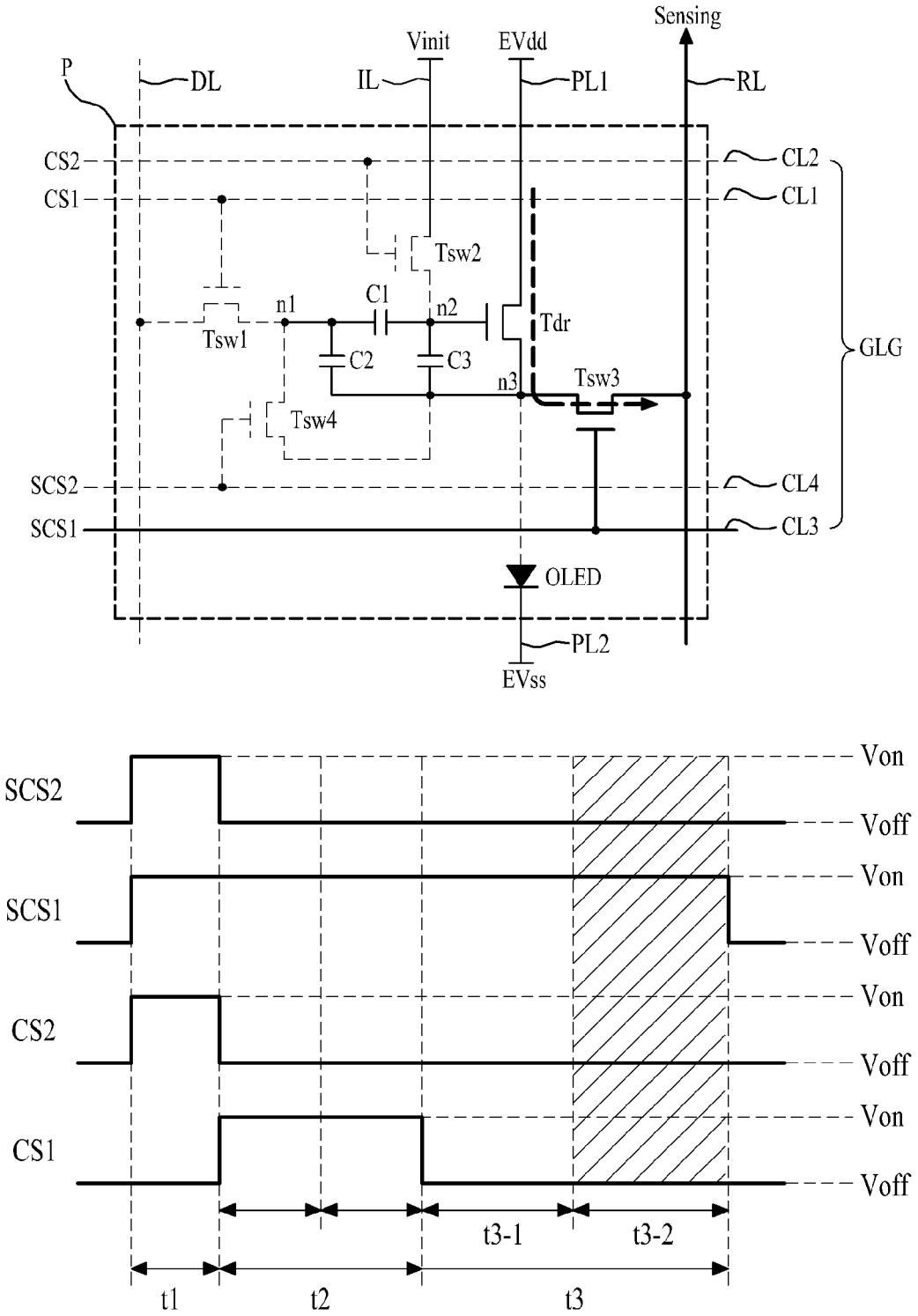

Subsequently, as illustrated in FIG. 6F, in the mobility sensing period t3-2 of the second sensing period t3, the first, second and fourth switching transistors Tsw1, Tsw2 and TSw4 may maintain a turn-off state, and the third switching transistor Tsw3 may maintain a turn-on state. At this time, the reference line RL is connected to the ADC (not shown) of the sensing unit (not shown).

Therefore, in the mobility sensing period t3-2, a voltage corresponding to a current which flows in the driving transistor Tdr may be charged into the reference line RL due to the voltage "Vdata_sen−Vref" stored in the second capacitor C2, and at a specific time, the ADC of the sensing unit senses (or samples) the voltage of the reference line RL and performs analog-digital conversion to generate mobility sensing data. The mobility sensing data may be supplied to the timing controller (not shown) of the organic light emitting display device, and the timing controller may calculate a mobility change of the driving transistor Tdr on the basis of the mobility sensing data of a pixel, calculate mobility compensation data used to compensate for a mobility deviation between pixels, and correct input data on the basis of the mobility compensation data in the display mode, thereby compensating for the mobility of the driving transistor Tdr through data correction.

Figure 7:
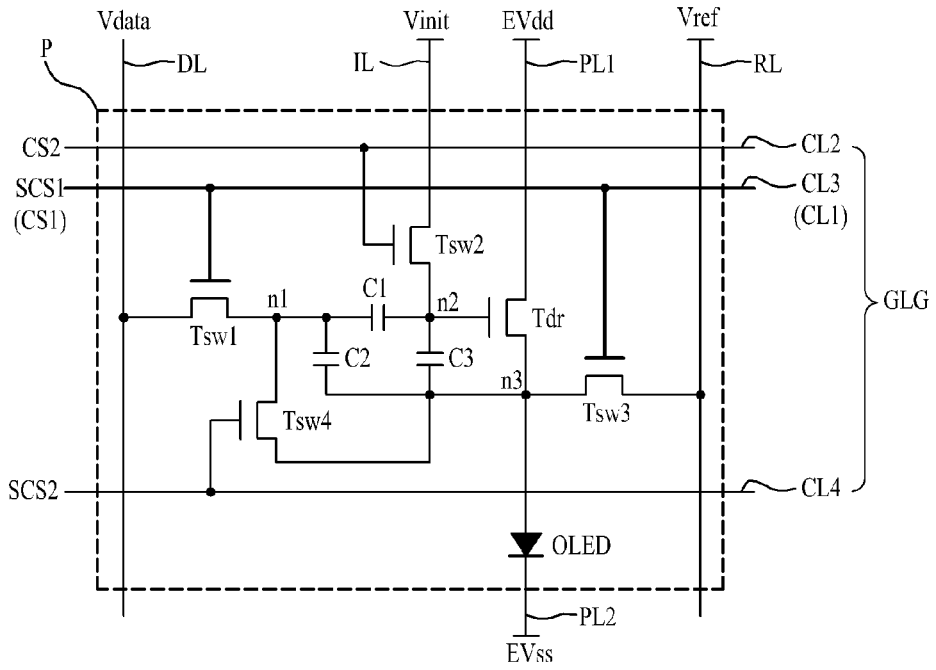
FIG. 7 is a diagram illustrating a pixel structure according to a second embodiment of the present invention.

FIG. 7 is a diagram illustrating a pixel P structure according to an example of a second embodiment of the present invention, which may be configured by omitting the scan control line CL1 (or the first sensing control line CL3) of the gate line group GLG. Hereinafter, only different elements may be described.

As seen in FIG. 7, in the pixel P structure according to an example of the second embodiment of the present invention, first and third switching transistors Tsw1 and Tsw3 may be simultaneously turned on or off. In detail, a first sensing control line CL3 (or the scan control line CL1) of a gate line group GLG may be connected to gate electrodes of the first and third switching transistors Tsw1 and Tsw3 in common. Therefore, the first and third switching transistors Tsw1 and Tsw3 may be simultaneously turned on or off according to a first sensing control signal SCS1 (or a scan control signal CS1) supplied to the first sensing control line CL3 (or the scan control line CL1).

As described above, the pixel P according to an example of the second embodiment may operate in a display mode, a normal compensation mode, an amplification compensation mode, or an external sensing mode. In each of the modes, the first and third switching transistors Tsw1 and Tsw3 may be are simultaneously turned on or off.

According to this embodiment, the first and third switching transistors Tsw1 and Tsw3 may be simultaneously turned on/off, but a method of driving the pixel P based on the display mode illustrated in FIG. 7 may otherwise be the same as or similar to the method of driving the pixel illustrated in FIGS. 3A to 3C. That is, the first and third switching transistors Tsw1 and Tsw3 may be simultaneously turned on in the initialization period t0 and the data addressing period t1 according to the first sensing control signal SCS1 supplied to the first sensing control line CL3, and may be simultaneously turned off in the emission period t2. However, in the initialization period t0, a data voltage Vdata may not be supplied to a data line DL. Therefore, the display mode of the pixel P according to the second embodiment of the present invention may provide the same or similar effect as that of the display mode of the pixel illustrated in FIG. 2.

Other than the first and third switching transistors Tsw1 and Tsw3 being simultaneously turned on/off, a method of driving the pixel P based on the normal compensation mode illustrated in FIG. 7 may be the same as or similar to the method of driving the pixel illustrated in FIGS. 4A to 4D. That is, the first and third switching transistors Tsw1 and Tsw3 may be simultaneously turned on in the initialization period t1 and the data addressing period t3 according to the first sensing control signal SCS1 supplied to the first sensing control line CL3, and may be simultaneously turned off in the sampling period t2 and the emission period t4. However, in the initialization period t1, the data voltage Vdata may not be supplied to the data line DL. Therefore, the normal compensation mode of the pixel P according to the second embodiment may provide the same or similar effect as that of the normal compensation mode of the pixel illustrated in FIG. 2.

Furthermore, other than the first and third switching transistors Tsw1 and Tsw3 being simultaneously turned on/off, a method of driving the pixel P based on the amplification compensation mode illustrated in FIG. 7 may be the same as or similar to the method of driving the pixel illustrated in FIGS. 5A to 5F. That is, the first and third switching transistors Tsw1 and Tsw3 may be simultaneously turned on in the initialization period t1, the first and second sub sampling periods t2-1 and t2-2 of the sampling period t2, and the data addressing period t3 according to the first sensing control signal SCS1 supplied to the first sensing control line CL3, and may be simultaneously turned off in the third sub sampling period t2-3 of the sampling period t2 and the emission period t4. However, in the initialization period t1, the data voltage Vdata may not be supplied to the data line DL. In addition, the first sensing control signal SCS1 may be changed to simultaneously turn on the first and third switching transistors Tsw1 and Tsw3 in the third sub sampling period t2-3 of the sampling period t2. Therefore, the amplification compensation mode of the pixel P according to the second embodiment of the present invention may provide the same or similar effect as that of the amplification compensation mode of the pixel illustrated in FIG. 2.

Also, other than the first and third switching transistors Tsw1 and Tsw3 being simultaneously turned on/off, a method of driving the pixel P based on the external sensing mode illustrated in FIG. 7 may be the same as or similar to the method of driving the pixel illustrated in FIGS. 6A to 6F. That is, the first and third switching transistors Tsw1 and Tsw3 may be simultaneously turned on in the initialization period t1 and the first and second sensing periods t2 and t3 according to the first sensing control signal SCS1 supplied to the first sensing control line CL3. However, in the initialization period t1 and the second sensing period t3, the data voltage Vdata may not be supplied to the data line DL. Therefore, the external sensing mode of the pixel P according to the second embodiment of the present invention may provide the same or similar effect as that of the external sensing mode of the pixel illustrated in FIG. 2.

In the pixel P according to the second embodiment and the driving method thereof, the scan control line (or the first sensing control line) of the gate line group GLG may be omitted. Accordingly, an aperture ratio of the pixel P can be improved, and the same or similar effect as that of the pixel P according to the first embodiment of the present invention may be provided.

Figure 8:
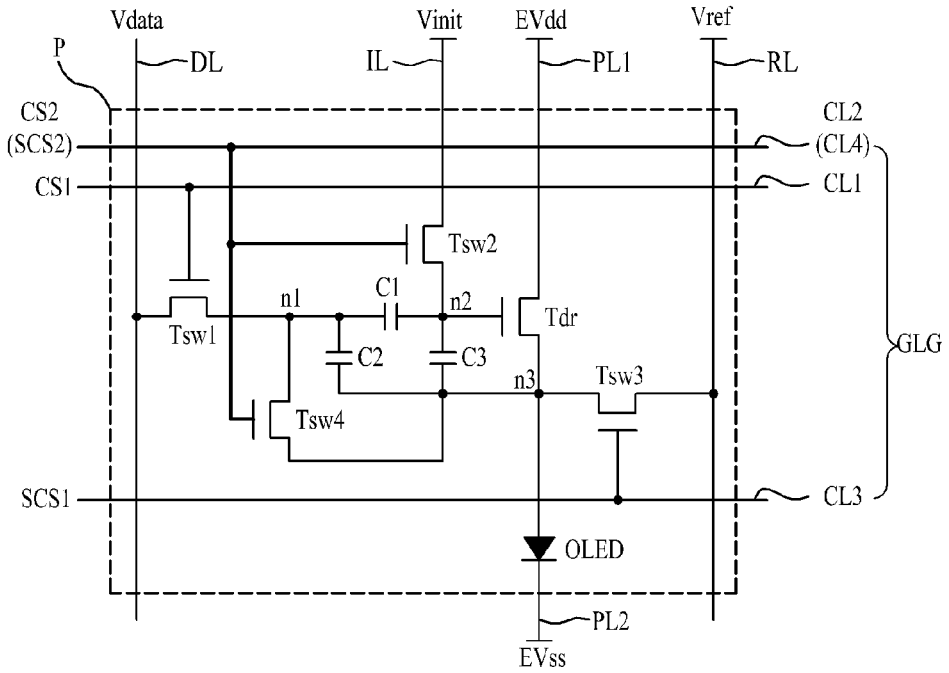
FIG. 8 is a diagram illustrating a pixel structure according to a third embodiment of the present invention.

FIG. 8 is a diagram illustrating an example pixel structure according to a third embodiment of the present invention, which may be configured by omitting the second sensing control line (or the initial control line) of the gate line group GLG. Hereinafter, only different elements may be described.

As seen in FIG. 8, in the pixel P structure according to an example of the third embodiment, second and fourth switching transistors Tsw2 and Tsw4 may be simultaneously turned on or off. In detail, an initial control line CL2 (or a second sensing control line CL4) of a gate line group GLG may be connected to gate electrodes of the second and fourth switching transistors Tsw2 and Tsw4 in common. Therefore, the second and fourth switching transistors Tsw2 and Tsw4 may be simultaneously turned on or off according to an initial control signal CS2 (or a second sensing control signal SCS2) supplied to the initial control line CL2 (or the second sensing control line CL4).

As described above, the pixel P according to the third embodiment may operate in a display mode, a normal compensation mode, an amplification compensation mode, or an external sensing mode. In each of the modes, the second and fourth switching transistors Tsw2 and Tsw4 may be simultaneously turned on or off. Here, as seen in FIGS. 3A to 3C, 4A to 4D, 5A to 5F, or 6A to 6F, because the second and fourth switching transistors Tsw2 and Tsw4 are simultaneously turned on/off, although the second and fourth switching transistors Tsw2 and Tsw4 are connected to the initial control line CL2 (or the second sensing control line CL4) in common, the second and fourth switching transistors Tsw2 and Tsw4 may not affect that the pixel P is driven in a corresponding mode.

In the pixel P according to the third embodiment and the driving method thereof, the second sensing control line (or the initial control line) of the gate line group GLG may be omitted. Accordingly, an aperture ratio of the pixel P can be improved, and the same or similar effect as that of the pixel P according to the first embodiment of the present invention may be provided.

Figure 9:
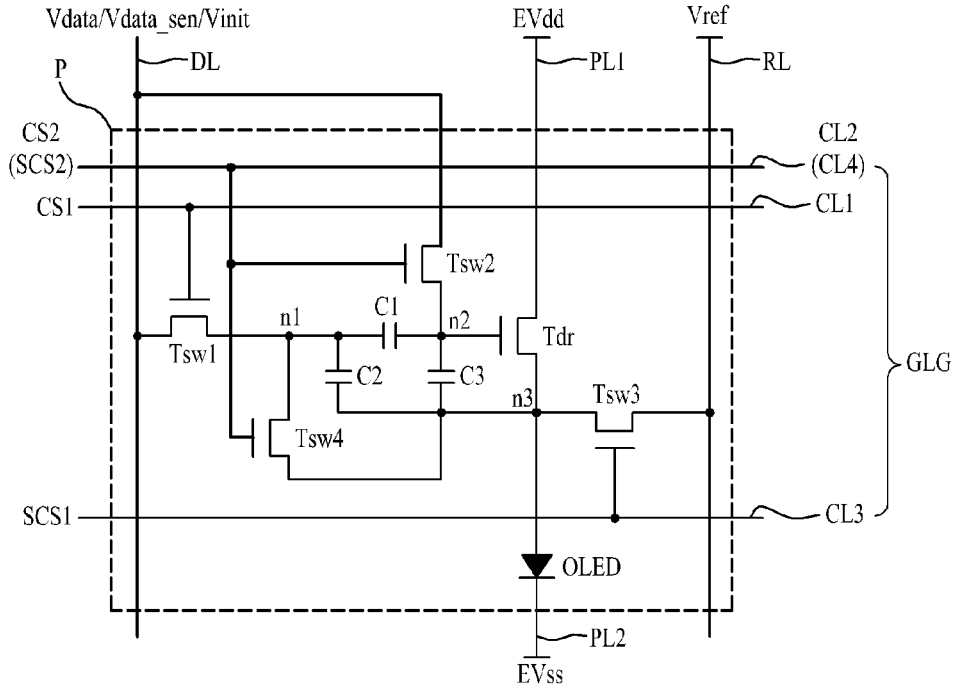
FIG. 9 is a diagram illustrating a pixel structure according to a fourth embodiment of the present invention.

FIG. 9 is a diagram illustrating an example pixel structure according to a fourth embodiment of the present invention, which may be configured by omitting the second sensing control line (or the initial control line) of the gate line group GLG and the initial voltage line IL. Hereinafter, only different elements may be described.

As seen in FIG. 9, in the pixel P structure according to an example of the fourth embodiment of the present invention, second and fourth switching transistors Tsw2 and Tsw4 may be simultaneously turned on or off. This may be the same as or similar to the pixel P of FIG. 8. However, because the initial voltage line IL which supplies an initial voltage Vinit to a first electrode of the second switching transistor Tsw2 may be omitted, the first electrode of the second switching transistor Tsw2 may be connected to a data line DL. Therefore, a data voltage Vdata, a sensing data voltage Vdata_sen, or the initial voltage Vinit may be selectively supplied to the data line DL depending on a driving method of a pixel.

In the pixel P according to the fourth embodiment of the present invention and the driving method thereof, the second sensing control line (or the initial control line) of the gate line group GLG and the initial voltage line IL may be omitted. Accordingly, an aperture ratio of the pixel P may be improved, and the same or similar effect as that of the pixel P according to the first embodiment of the present invention may be provided.

Figure 10:
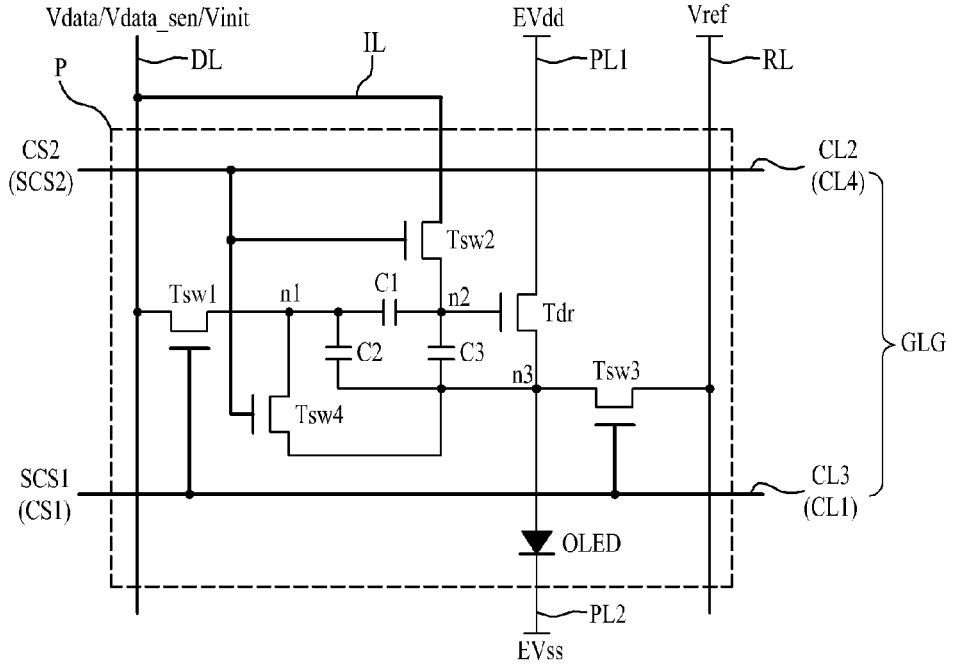
FIG. 10 is a diagram illustrating a pixel structure according to a fifth embodiment of the present invention.

FIG. 10 is a diagram illustrating an example pixel structure according to a fifth embodiment of the present invention, which may be configured by omitting the scan control line CL1 (or the first sensing control line CL3) and second sensing control line (or the initial control line) of the gate line group GLG and the initial voltage line IL. Hereinafter, only different elements may be described.

As seen in FIG. 10, in the pixel P structure according to an example of the fifth embodiment of the present invention, first and third switching transistors Tsw1 and Tsw3 may be simultaneously turned on or off, and second and fourth switching transistors Tsw2 and Tsw4 may be simultaneously turned on or off. This may be implemented by combining, for example, the structures of the pixels P of FIGS. 7 to 9.

In the pixel P according to the fifth embodiment and the driving method thereof, the scan control line CL1 (or the first sensing control line CL3) and second sensing control line (or the initial control line) of the gate line group GLG and the initial voltage line IL may be omitted. Accordingly, an aperture ratio of the pixel P may be improved, and the same or similar effect as that of the pixel P according to the first embodiment may be provided.

Figure 11:
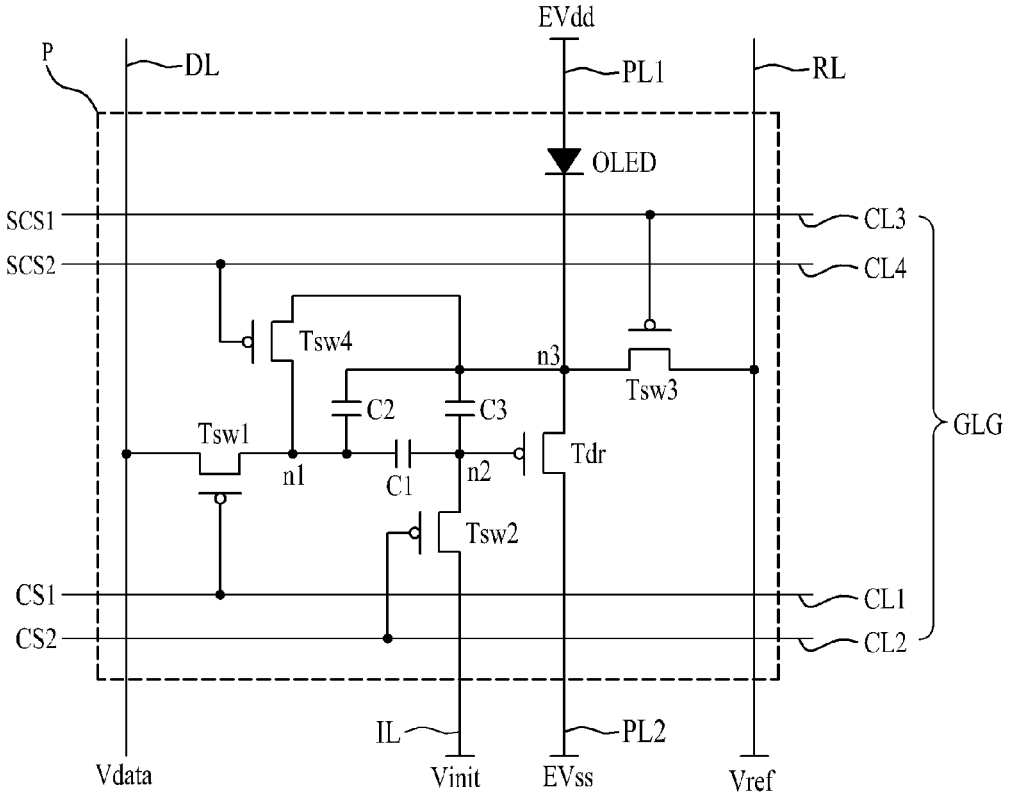
FIG. 11 is a diagram illustrating a pixel structure according to a sixth embodiment of the present invention.

FIG. 11 is a diagram illustrating an example pixel structure according to a sixth embodiment of the present invention. In FIG. 11, each of first to fourth switching transistors Tsw1 to Tsw4 and a driving transistor Tdr may be a P-type thin film transistor (TFT). Hereinafter, only different elements may be described.

The pixel P may include an organic light emitting diode OLED, first to fourth switching transistors Tsw1 to Tsw4, first to third capacitors C1 to C3, and a driving transistor Tdr. Because each of the first to fourth transistors Tsw1 to Tsw4 and the driving transistor Tdr may be a P-type TFT, except for a connection structure of the organic light emitting diode OLED and the driving transistor Tdr, the pixel P may be the same as or similar to the pixel according to one of the first to fifth embodiments, and thus, a repetitive description for the same or similar elements is not provided.

The organic light emitting diode OLED may be connected between the driving transistor Tdr and a first driving power line PL1 through which a high-level voltage EVdd may be supplied. The organic light emitting diode OLED may include an anode electrode connected to the first driving power line PL1, an organic layer (not shown) formed on the anode electrode, and a cathode electrode connected to a source electrode of the driving transistor Tdr.

The driving transistor Tdr may include a gate electrode connected to the second node n2, a source electrode connected to the cathode electrode of the organic light emitting diode OLED, and a drain electrode connected to a second driving power line PL2 through which a low-level voltage EVss may be supplied.

Except that each of the control signals CS1, CS2, SCS1 and SCS2 may be changed to a voltage level for turning on/off a P-type TFT, a method of driving the pixel P according to the sixth embodiment of the present invention may be the same as or similar to the method of driving the pixel illustrated in FIGS. 3A to 3C, 4A to 4D, 5A to 5F, or 6A to 6F, and thus, a repetitive description is not provided.

In addition, as seen in FIGS. 7 to 10, at least one line selected from a scan control line CL1 and second sensing control line CL4 of a gate line group GLG and an initial voltage line IL may be omitted in the pixel illustrated in FIG. 11.

The pixel P according to examples of the sixth embodiment of the present invention may provide the same or similar effect as that of the pixel according to each of the aforementioned first to fifth embodiments.

Figure 12:
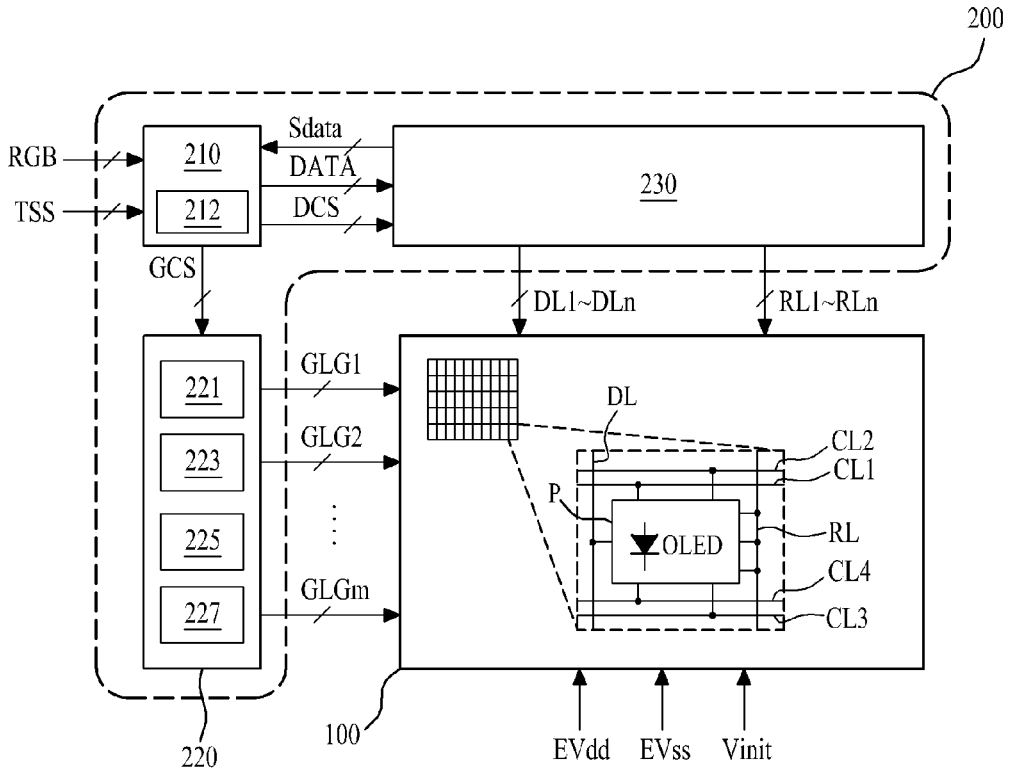
FIG. 12 is a diagram for describing an organic light emitting display device according to an embodiment of the present invention.

FIG. 12 is a diagram for describing an organic light emitting display device according to an embodiment of the present invention. With reference to FIG. 12, the organic light emitting display device according to an embodiment of the present invention may include a display panel 100 and a panel driver 200. The display panel 100 may include a plurality of data lines DL1 to DLn, a plurality of reference lines RL1 to RLn, a plurality of gate line groups GLG1 to GLGm, and a plurality of pixels P.

The plurality of data lines DL1 to DLn may be arranged in parallel at certain intervals along a first direction (i.e., a height direction) of the display panel 100. The plurality of reference lines RL1 to RLn may be arranged at certain intervals in parallel with the plurality of data lines DL1 to DLn, and may receive a reference voltage Vref having a constant DC level from the outside.

The plurality of gate line groups GLG1 to GLGm are arranged along a second direction (i.e., a width direction) of the display panel 100 so as to intersect the data lines DL. The gate line group GLG may include a scan control line CL1, an initial control line CL2, a first sensing control line CL3, and a second sensing control line CL4.

In addition, the display panel 100 may further include a first driving power line PL1, a second driving power line PL2, and an initial power line IL which may be connected to each of the plurality of pixels P. The first driving power line PL1 may be formed in parallel with the data line DL, and may be supplied with a high-level voltage EVdd from the outside. The second driving power line PL2 may be formed in a one-piece form or a line form so as to be connected to an organic light emitting diode, and may be supplied with a low-level voltage EVss from the outside. The initial voltage line IL may be formed in parallel with the data line DL or the scan control line CL1, and may be supplied with an initial voltage Vinit from the outside. Here, the reference voltage Vref and the initial voltage Vinit may have the same voltage level or different voltage levels.

Each of the plurality of pixels P may be one of a red pixel, a green pixel, a blue pixel, and a white pixel. One unit pixel that displays one image may include a red pixel, a green pixel, a blue pixel, and a white pixel which are adjacent to each other, or include a red pixel, a green pixel, and a blue pixel which are adjacent to each other. Each pixel P may have the pixel structure illustrated in one of FIGS. 2 and 7 to 12, and thus, repetitive description may not be provided.

The panel driver 200, as described above, may operate each pixel P (which may be formed in the display panel 100) in the display mode, the normal compensation mode, the amplification compensation mode, or the external sensing mode. For example, the panel driver 200 may perform the display mode, the normal compensation mode, the amplification compensation mode, or the external sensing mode for the pixel P in units of at least one horizontal line at every vertical blank interval, and thus decrease a switching duty of each of the first to fourth switching transistors Tsw1 to Tsw4 per frame for the compensation mode or the sensing mode, thereby enhancing a reliability of the first to fourth switching transistors Tsw1 to Tsw4.

In the external sensing mode, the panel driver 200 may sense a characteristic change (for example, a threshold voltage and/or mobility) of the driving transistor Tdr of each pixel P through a corresponding reference line RL to generate sensing data Sdata.

The panel driver 200 may include a timing controller 210, a gate driving circuit unit 220, and a column driver 230.

Based on a timing synch signal TSS input from the outside, the timing controller 210 may generate a gate control signal GCS and a data control signal DCS for controlling the gate driving circuit unit 220 and the column driver 230 to the normal compensation mode, the amplification compensation mode, the external sensing mode, or the display mode based on the external sensing mode.

In the display mode, the normal compensation mode, the amplification compensation mode, or the external sensing mode, the timing controller 210 may align input data RGB supplied from the outside so as to match a pixel arrangement structure of the display panel 100 to generate pixel data DATA by pixel, or generate sensing data DATA to supply the sensing data to the column driver 230.

In the display mode based on the external sensing mode, the timing controller 210 calculates sensing compensation data by pixel which may be used to compensate for a threshold voltage and/or mobility of the driving transistor Tdr of each pixel P, based on sensing data Sdata by pixel which may be supplied from the column driver 230, and compares the calculated sensing compensation data by pixel and previous compensation data by pixel stored in a memory 212 to calculate a deviation value. The timing controller 210 may add or subtract the calculated deviation value to or from the previous compensation data by pixel to generate compensation data by pixel, and store the generated compensation data by pixel in the memory 212, thereby updating compensation data by pixel stored in the memory 212. Then, the timing controller 210 may correct input data RGB by pixel supplied from the outside, based on the compensation data by pixel stored in the memory 212, to generate pixel data DATA by pixel.

The gate driving circuit unit 220 may generate the control signals CS1, CS2, SCS1 and SCS2 which are as illustrated in FIG. 3A, 4A, 5A or 6A, in response to the gate control signal GCS supplied from the timing controller 210 according to a mode, and may supply the control signals CS1, CS2, SCS1 and SCS2 to the control lines CL1 to CL4 formed in the display panel 100.

The gate driving circuit unit 220 according to an embodiment of the present invention may include a scan line driver 221, an initial line driver 223, a first sensing line driver 225, and a second sensing line driver 227.

The scan line driver 221 may be connected to the scan control line CL1 of each of the gate line groups GLG1 to GLGm. The scan line driver 221 may generate the scan control signal CS1 which may be as illustrated in FIG. 3A, 4A, 5A or 6A, in response to the gate control signal GCS, and sequentially may supply the scan control signal CS1 to the scan control line CL1 of each of the gate line groups GLG1 to GLGm.

The initial line driver 223 may be connected to the initial control line CL2 of each of the gate line groups GLG1 to GLGm. The initial line driver 223 may generate the initial control signal CS2 which may be as illustrated in FIG. 3A, 4A, 5A or 6A, in response to the gate control signal GCS, and sequentially may supply the initial control signal CS2 to the initial control line CL2 of each of the gate line groups GLG1 to GLGm.

The first sensing line driver 225 may be connected to the first sensing control line CL3 of each of the gate line groups GLG1 to GLGm. The first sensing line driver 225 may generate the first sensing control signal SCS1 which may be as illustrated in FIG. 3A, 4A, 5A or 6A, in response to the gate control signal GCS, and sequentially may supply the first sensing control signal SCS1 to the first sensing control line CL3 of each of the gate line groups GLG1 to GLGm.

The second sensing line driver 227 may be connected to the second sensing control line CL4 of each of the gate line groups GLG1 to GLGm. The second sensing line driver 227 may generate the second sensing control signal SCS2 which may be as illustrated in FIG. 3A, 4A, 5A or 6A, in response to the gate control signal GCS, and sequentially may supply the second sensing control signal SCS2 to the second sensing control line CL4 of each of the gate line groups GLG1 to GLGm.

The gate driving circuit unit 220 may be directly provided on the display panel 100 simultaneously with a process of forming a TFT of each pixel P, or may be provided in an integrated circuit (IC) type, and may be connected to one side of each of the control lines CL1 to CL4.

When the pixel P is configured as illustrated in FIG. 7, the scan line driver 221 (or the first sensing line driver 225) may be omitted. When the pixel P is configured as illustrated in FIG. 8 or 9, the initial line driver 223 (or the second sensing line driver 227) may be omitted. When the pixel P is configured as illustrated in FIG. 10, the scan line driver 221 (or the first sensing line driver 225) and the initial line driver 223 (or the second sensing line driver 227) may be omitted.

The column driver 230 may be connected to the plurality of data lines DL1 to DLn and the plurality of reference lines RL1 to RLn, and may operate in the normal compensation mode, the amplification compensation mode, the external sensing mode, or the display mode based on the external sensing mode, according to a mode control of the timing controller 210.

In the data addressing period illustrated by example in FIG. 3B, 4C, or 5E, the column driver 230 may digital-analog convert input pixel data DATA by pixel to generate a data voltage Vdata, and may supply the data voltage Vdata to a corresponding data line DL. Alternatively, in the first and second sub sampling periods t2-1 and t2-2 illustrated in FIGS. 5B and 5C, the column driver 230 may digital-analog convert input sensing data DATA to generate a sensing data voltage Vdata_sen, and may supply the sensing data voltage Vdata_sen to a corresponding data line. To this end, the column driver 230 may include a shift register (not shown), a latch (not shown), a grayscale voltage generator (not shown), and first to nth digital-to-analog converters (not shown).

The shift register may shift a source start signal of the data control signal DCS according to a source shift clock of the data control signal DCS to sequentially output a plurality of sampling signals. The latch may sequentially sample and latch input pixel data DATA according to the sampling signals, and simultaneously output latch data for one horizontal line according to a source output enable signal of the data control signal DCS. The grayscale voltage generator generates a plurality of grayscale voltages respectively corresponding to grayscale levels of the pixel data DATA by using a plurality of reference gamma voltages input from the outside. Each of the first to nth digital-to-analog converters may select, as a data voltage Vdata, a grayscale voltage corresponding to the latch data among the plurality of grayscale voltages supplied from the grayscale voltage generator, and output the selected data voltage to a corresponding data line DL.

Figure 13:
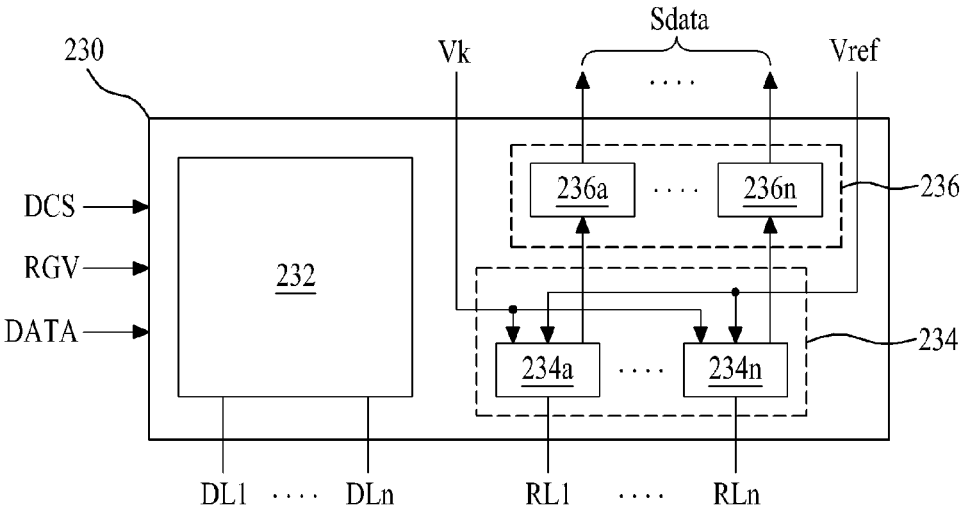
FIG. 13 is a diagram for describing a column driver of FIG. 12.

In the external sensing mode, the column driver 230 senses a threshold voltage and/or mobility of the driving transistor Tdr of each pixel P in response to the data control signal DCS supplied from the timing controller 210 to generate sensing data Sdata, and may supply the generated sensing data Sdata to the timing controller 210. To this end, as illustrated in FIG. 13, the column driver 230 according to another embodiment of the present invention may include a data driver 232, a switching unit 234, and a sensing unit 236.

The data driver 232 converts pixel data DATA (or sensing data), supplied from the timing controller 210, into data voltages Vdata in response to the data control signal DCS supplied from the timing controller 210 according to the external sensing mode or the display mode, and respectively may supply the data voltages to the data lines DL1 to DLn. The data driver 232 may include the shifter register, the latch, the grayscale voltage generator, and the first to nth digital-to-analog converters.

The switching unit 234 may supply a reference voltage Vref or a mobility sensing voltage Vk to the reference line RL, or float the reference line RL, in response to a switching control signal (not shown) supplied from the timing controller 210. That is, in the external sensing mode, as illustrated in FIGS. 6A to 6F, the switching unit 234 may supply the reference voltage Vref to the reference line RL in the initialization period t1, float the reference line RL in the floating period t2-1, connect the reference line RL to the sensing unit 236 in the threshold voltage sensing period t2-2 or the mobility sensing period t3-2, and may supply the mobility sensing voltage Vk to the reference line RL in the sensing voltage charging period t3-1. To this end, the switching unit 234 according to an embodiment of the present invention may include a plurality of selectors 234*a* to 234*n* which are connected to the respective reference lines RL1 to RLn and the sensing unit 236. Each of the selectors 234*a* to 234*n* may be configured with a multiplexer.

In the external sensing mode, for example, the threshold voltage sensing period t2-2 or the mobility sensing period t3-2, the sensing unit 236 may be connected to the plurality of reference lines RL1 to RLn through the switching unit 234 to sense voltages of the plurality of reference lines RL1 to RLn, generates sensing data Sdata corresponding to the sensed voltages, and may supply the sensing data Sdata to the timing controller 210. To this end, the sensing unit 236 may include a plurality of analog-to-digital converters ADCs 236*a* to 236*n* which are respectively connected to the plurality of reference lines RL1 to RLn through the switching unit 234, and analog-digital convert respective sensing voltages to generate the sensing data Sdata.

As described above, the organic light emitting display device according to an embodiment of the present invention may selectively drive each pixel in an internal compensation method or an external compensation method by changing the turn-on/off of the four switching transistors Tsw1 to Tsw4. That is, example embodiments may store the threshold voltage of the driving transistor Tdr in the first capacitor C1 according to the turn-on/off of the four switching transistors Tsw1 to Tsw4, thereby compensating for the threshold voltage of the driving transistor Tdr in the internal compensation method. In this case, the example embodiments emit light from an organic light emitting diode while continuously maintaining the threshold voltage of the driving transistor Tdr stored in the first capacitor C1, and thus decrease a deterioration of the switching transistors Tsw1 to Tsw4 for compensating for the driving transistor Tdr, thereby increasing a reliability and service life of the switching transistors Tsw1 to Tsw4. Also, example embodiments externally sense the threshold voltage and/or mobility of the driving transistor Tdr according to the turn-on/off of the four switching transistors Tsw1 to Tsw4, and correct data to compensate for the threshold voltage and/or mobility of the driving transistor Tdr by using the external compensation method. Therefore, example embodiments of present invention accurately compensate for a threshold voltage and/or mobility deviation of a driving transistor between pixels, thereby improving a quality of an image.

Figure 14:
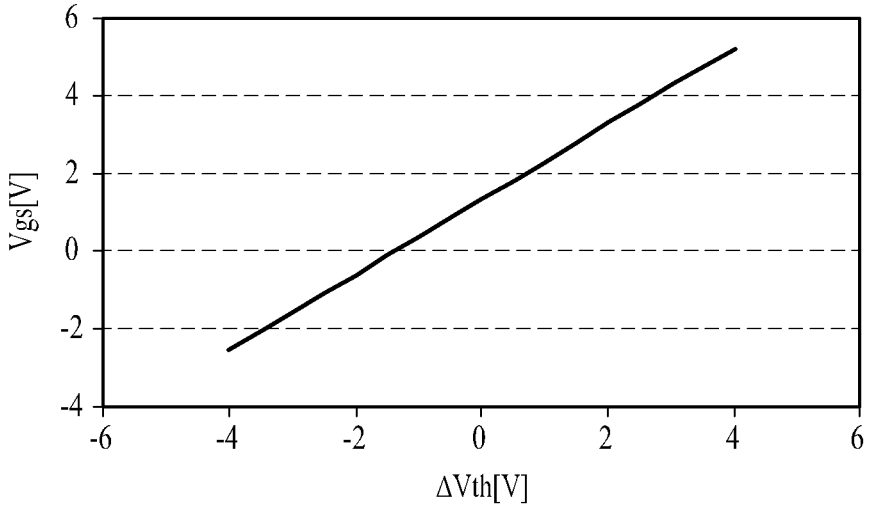
FIG. 14 is a simulation graph showing a shift of a gate-source voltage caused by a threshold voltage shift of a driving transistor of a pixel, in an embodiment of the present invention.

FIG. 14 is a simulation graph showing a shift of a gate-source voltage caused by a threshold voltage shift of a driving transistor of a pixel, in example embodiments of the present invention.

As seen in FIG. 14, it can be seen that a gate-source voltage Vgs of a driving transistor may be linearly shifted in correspondence with a threshold voltage shift ΔVth of the driving transistor, and it can be seen that a slope of the gate-source voltage Vgs, which may be shifted according to the threshold voltage shift ΔVth of the driving transistor, may be approximately 1. Therefore, it can be checked that a compensation performance of the pixel P according to example embodiments of the present invention is 97% or more with respect to the gate-source voltage Vgs.

As described above, embodiments of the present invention may sample a threshold voltage of a driving transistor, store the sampled threshold voltage of the driving transistor in a capacitor, and emit light from an organic light emitting diode while continuously maintaining the threshold voltage of the driving transistor stored in the capacitor. Therefore, embodiments of the present invention may compensate for the threshold voltage of the driving transistor, and decrease a deterioration of a switching transistor for compensating for the driving transistor, thereby increasing a reliability and service life of the switching transistor.

Moreover, embodiments of the present invention may externally sense a threshold voltage and/or mobility of a driving transistor, and correct data to compensate for the threshold voltage and/or mobility of the driving transistor by using the external compensation method. Therefore, embodiments of the present invention may accurately compensate for a threshold voltage and/or mobility deviation of a driving transistor between pixels, thereby improving a quality of an image.

Moreover, embodiments of the present invention may compensate for a driving characteristic change of a driving transistor included in each pixel by selectively using the internal compensation method and the external compensation method.

It will be apparent to those skilled in the art that various modifications and variations can be made in the present invention without departing from the spirit or scope of the inventions. Thus, it is intended that the present invention cover the modifications and variations of this invention provided they come within the scope of the appended claims and their equivalents.

What is claimed is:

1. An organic light emitting display device, comprising:

a pixel connected to a data line, a gate line group, and a reference line, the pixel including an organic light emitting diode (OLED);

a driving transistor configured to control a current to flow through the OLED;

a first switching transistor configured to selectively supply a data voltage from the data line to a first node;

a second switching transistor configured to selectively supply an initial voltage to a second node, wherein the second node is a gate electrode of the driving transistor;

a third switching transistor configured to selectively connect a third node to the reference line, wherein the third node is a source electrode of the driving transistor;

a fourth switching transistor configured to selectively connect the first node to the third node;

a first capacitor connected between the first and second nodes to store a threshold voltage of the driving transistor; and a second capacitor connected between the first and third nodes to store the data voltage supplied through the first switching transistor.

2. The organic light emitting display device of claim 1, wherein:

the threshold voltage of the driving transistor is stored in the first capacitor;

the pixel is driven in a data addressing period and an emission period;

the first switching transistor is turned on in the data addressing period, and supplies the data voltage to the first node;

the third switching transistor is turned on in the data addressing period, and supplies a voltage, supplied to the reference line, to the third node; and the second and fourth switching transistors are turned off in the data addressing period and the emission period.

3. The organic light emitting display device of claim 1, wherein:

the pixel is driven in an initialization period, a data addressing period and an emission period;

the first switching transistor is turned on in the data addressing period, and supplies the data voltage to the first node;

the second switching transistor is turned on in the initialization period, and supplies the initial voltage to the second node;

the third switching transistor is turned on in the initialization period and the data addressing period, and supplies a voltage, supplied to the reference line, to the third node; and the fourth switching transistor is turned on in the initialization period, and connects the first node to the third node.

4. The organic light emitting display device of claim 3, wherein the data voltage comprises a compensation voltage for compensating for at least one selected from a threshold voltage and a mobility of the driving transistor.

5. The organic light emitting display device of claim 1, wherein:

the pixel is driven in an initialization period, a sampling period, a data addressing period, and an emission period;

the first switching transistor is turned on in the data addressing period, and supplies the data voltage to the first node;

the second switching transistor is turned on in the initialization period and the sampling period, and supplies the initial voltage to the second node;

the third switching transistor is turned on in the initialization period and the data addressing period, and supplies a voltage, supplied to the reference line, to the third node; and the fourth switching transistor is turned on in the initialization period and the sampling period, and connects the first node to the third node.

6. The organic light emitting display device of claim 1, wherein:

the pixel is driven in an initialization period, a sampling period including first to third sub sampling periods, a data addressing period and an emission period;

the first switching transistor is turned on in the first and second sub sampling periods and the data addressing period, and supplies the data voltage to the first node;

the second switching transistor is turned on in the initialization period and the third sub sampling period, and supplies the initial voltage to the second node;

the third switching transistor is turned on in the initialization period, the first sub sampling period, and the data addressing period, and supplies a voltage, supplied to the reference line, to the third node; and the fourth switching transistor is turned on in the initialization period and the third sub sampling period, and connects the first node to the third node.

7. The organic light emitting display device of claim 1, further comprising:

a sensing unit configured to sense a gate-source voltage of the driving transistor through the reference line to generate sensing data, wherein:

the pixel is driven in an initialization period and a first sensing period;

the first switching transistor is turned on in the first sensing period, and supplies the data voltage to the first node;

the second switching transistor is turned on in the initialization period, and supplies the initial voltage to the second node;

the third switching transistor is turned on in the initialization period and the first sensing period, and supplies a voltage, supplied to the reference line, to the third node; and the fourth switching transistor is turned on in the initialization period, and connects the first node to the third node.

8. The organic light emitting display device of claim 7, wherein:

the first sensing period comprises a floating period and a threshold voltage sensing period;

the reference line is floated in the floating period; and the reference line is connected to the sensing unit in the threshold voltage sensing period.

9. The organic light emitting display device of claim 7, wherein:

the pixel is further driven in a second sensing period after the first sensing period;

the third switching transistor is turned on in the second sensing period; and in the second sensing period, the sensing unit senses a mobility of the driving transistor through the reference line to generate sensing data.

10. The organic light emitting display device of claim 9, wherein:

the second sensing period comprises a sensing voltage charging period and a mobility sensing period;

in the sensing voltage charging period, the third switching transistor supplies a mobility sensing voltage, supplied to the reference line, to the third node; and in the mobility sensing period, the reference line is connected to the sensing unit.

11. The organic light emitting display device of claim 1, further comprising a third capacitor connected between the second and third nodes.

12. The organic light emitting display device of claim 1, wherein:

the first and third switching transistors are simultaneously turned on/off;

the second and fourth switching transistors are simultaneously turned on/off; and the second switching transistor selectively supplies the initial voltage from the data line to the second node.

13. A method of driving an organic light emitting display device including a pixel connected to a data line, a gate line group, and a reference line, the method comprising:

controlling, using a driving transistor, a current to flow through an organic light emitting diode (OLED)

selectively supplying, using a first switching transistor, a data voltage from the data line to a first node;

selectively supplying, using a second switching transistor, an initial voltage to a second node, wherein the second node is a gate electrode of the driving transistor;

selectively connecting, using a third switching transistor, a third node to the reference line, wherein the third node is a source electrode of the driving transistor;

selectively connecting, using a fourth switching transistor, the first node to the third node, wherein a first capacitor is connected between the first and second nodes to store a threshold voltage of the driving transistor; and a second capacitor is connected between the first and third nodes to store the data voltage supplied through the first switching transistor.

14. The method of driving the organic light emitting display device of claim 13, the method further comprising:

supplying the data voltage to the first node, and supplying the reference voltage to the third node to store a difference voltage between the data voltage and the reference voltage in the second capacitor; and driving the driving transistor with a voltage stored in each of the first and second capacitors to emit light from the OLED, wherein the threshold voltage of the driving transistor is previously stored in the first capacitor.

15. The method of driving the organic light emitting display device of claim 13, the method further comprising:

supplying the reference voltage, supplied to the reference line, to the first and third nodes, and supplying the initial voltage to the second node to initialize the first to third nodes;

supplying the data voltage to the first node, and supplying the reference voltage to the third node to store a difference voltage between the data voltage and the reference voltage in the second capacitor; and driving the driving transistor with a voltage stored in each of the first and second capacitors to emit light from the OLED, wherein the data voltage comprises a compensation voltage for compensating for at least one of the threshold voltage and a mobility of the driving transistor.

16. The method of driving the organic light emitting display device of claim 13, the method further comprising:

supplying the reference voltage, supplied to the reference line, to the first and third nodes, and supplying the initial voltage to the second node to initialize the first to third nodes;

cutting off the reference voltage supplied to the first and third nodes, and supplying the initial voltage to the second node to store the threshold voltage of the driving transistor in the first capacitor;

supplying the data voltage to the first node, and supplying the reference voltage to the third node to store a difference voltage between the data voltage and the reference voltage in the second capacitor; and driving the driving transistor with a voltage stored in each of the first and second capacitors to emit light from the OLED.

17. The method of driving the organic light emitting display device of claim 13, the method further comprising:

supplying the reference voltage, supplied to the reference line, to the first and third nodes, and supplying the initial voltage to the second node to initialize the first to third nodes;

supplying a sensing data voltage, supplied to the data line, to the first node, supplying the reference voltage to the third node for a certain time and then cutting off the reference voltage to store the threshold voltage of the driving transistor in the second capacitor, and transferring the threshold voltage of the driving transistor, stored in the second capacitor, to the first capacitor;

supplying the data voltage to the first node, and supplying the reference voltage to the third node to store a difference voltage between the data voltage and the reference voltage in the second capacitor; and driving the driving transistor with a voltage stored in each of the first and second capacitors to emit light from the OLED.

18. The method of driving the organic light emitting display device of claim 13, the method further comprising:

(A) supplying the reference voltage, supplied to the reference line, to the first and third nodes, and supplying the initial voltage to the second node to initialize the first to third nodes; and (B) supplying a sensing data voltage, supplied to the data line, to the first node to drive the driving transistor, and sensing the threshold voltage of the driving transistor through the reference line.

19. The method of driving the organic light emitting display device of claim 18, wherein step (B) further comprises:

while the sensing data voltage is being supplied to the first node, supplying the reference voltage to the third node through the reference line to store a difference voltage between the sensing data voltage and the reference voltage in the second capacitor.

20. The method of driving the organic light emitting display device of claim 19, further comprising:

cutting off the sensing data voltage supplied to the first node, supplying a mobility sensing voltage to the third node to maintain a voltage stored in the second capacitor, and initializing a voltage of the first capacitor to 0V; and cutting off the mobility sensing voltage supplied to the third node to drive the driving transistor with the voltage of the second capacitor, and sensing a voltage corresponding to a mobility of the driving transistor through the reference line.

* * * * *